US009296217B2

(12) United States Patent
Obata

(10) Patent No.: US 9,296,217 B2
(45) Date of Patent: Mar. 29, 2016

(54) IMAGE FORMING DEVICE AND RECORDING HEAD MAINTENANCE METHOD

(71) Applicant: Konica Minolta, Inc., Tokyo (JP)

(72) Inventor: Mitsuru Obata, Kanagawa (JP)

(73) Assignee: KONICA MINOLTA, INC (JP)

( * ) Notice: Subject to any disclaimer, the term of this patent is extended or adjusted under 35 U.S.C. 154(b) by 0 days.

(21) Appl. No.: 14/385,254

(22) PCT Filed: Mar. 5, 2013

(86) PCT No.: PCT/JP2013/055946
§ 371 (c)(1),
(2) Date: Sep. 15, 2014

(87) PCT Pub. No.: WO2013/137057
PCT Pub. Date: Sep. 19, 2013

(65) Prior Publication Data

US 2015/0035901 A1 Feb. 5, 2015

(30) Foreign Application Priority Data

Mar. 14, 2012 (JP) ..... 2012-056646

(51) Int. Cl.

| | |
|---|---|
| ***B41J 2/165*** | (2006.01) |
| ***B41J 2/18*** | (2006.01) |
| ***B41J 2/175*** | (2006.01) |
| ***B41J 2/155*** | (2006.01) |

(52) U.S. Cl.
CPC .. *B41J 2/18* (2013.01); *B41J 2/155* (2013.01); *B41J 2/165* (2013.01); *B41J 2/175* (2013.01); *B41J 2/17509* (2013.01); *B41J 2/17596* (2013.01); *B41J 2202/20* (2013.01)

(58) Field of Classification Search
None
See application file for complete search history.

(56) References Cited

FOREIGN PATENT DOCUMENTS

| | | | |
|---|---|---|---|
| JP | 02000520 | A | 1/1990 |
| JP | 2006116955 | A | 5/2006 |
| JP | 2006150745 | A | 6/2006 |
| JP | 2007203649 | A | 8/2007 |
| JP | 2008264767 | A | 11/2008 |
| JP | 2009154328 | A | 7/2009 |
| JP | 2011056784 | A | 3/2011 |
| JP | 2011212872 | A | 10/2011 |
| JP | 2011255580 | A | 12/2011 |

OTHER PUBLICATIONS

Machine translation available on J-PLatPat of Nomura JP2006-150745.*

(Continued)

*Primary Examiner* — Alejandro Valencia
(74) *Attorney, Agent, or Firm* — Cantor Colburn LLP

(57) ABSTRACT

In order to perform recording head maintenance by discharge and reflux of ink with higher pressures without creating instability of the meniscus in the nozzle surface, this image forming device may be provided with a recording head having multiple nozzles, a first reservoir unit and a second reservoir unit which store the ink supplied to the recording head, a supply unit which is opened and closed by a solenoid valve and connects the recording head and the first reservoir unit, a pump which supplies the ink in the second reservoir unit to the first reservoir unit, a recovery passage which is opened and closed by solenoid valves and connects the recording head and the second reservoir unit, and a control unit which controls operation of the solenoid valves and the pump.

4 Claims, 15 Drawing Sheets

(56) References Cited

OTHER PUBLICATIONS

Machine translation available on J-PLatPat of Atsushi JP2008-264767.*
Machine translation available on J-PLatPat of Obata J P2011-255580.*
International Search Report for International Application No. PCT/JP2013/055946; Date of Mailing, Jun. 4, 2013; with English translation.
Japanese Office Action corresponding to Application No. 2014-504805: Date of Mailing: Feb. 9, 2016, with English translation.

* cited by examiner

IMAGE FORMING DEVICE AND RECORDING HEAD MAINTENANCE METHOD

CROSS REFERENCE TO RELATED APPLICATIONS

This is the U.S. national stage of application No. PCT/JP2013/055946, filed on Mar. 5, 2013. Priority under 35 U.S.C. §119 (a) and 35 U.S.C. §365(b) is claimed from Japanese Application No. 2012056646, filed Mar. 14, 2012, the disclosure of which is also incorporated herein by reference.

TECHNICAL FIELD

The present invention relates to an image forming device and a maintenance method for a recording head.

BACKGROUND ART

In an inkjet image forming device, when clogging of nozzles of recording heads to eject ink occurs or air bubbles come into ink before being ejected around the nozzles, the ink ejection from the nozzles is sometimes prevented, leading to poor image formation. Such an inkjet image forming device thus needs maintenance to remove clogging of the nozzles and to remove air bubbles from the ink.

As the maintenance method, a method called pressure purge is known. In the pressure purge, the ink in the nozzles is pressurized to be ejected from the nozzles at the timing other than the timing of image formation and thereby clogging of the nozzles is removed. A method called suction purge is also known for the maintenance using a suction part, which is separately provided, to suck the ink out of the nozzles.

A method for single-pass image formation has been proposed for speed-up of printing in recent years. The method performs printing by a single pass using a plurality of heads having a plurality of nozzles arranged in the width direction of a sheet.

If the suction purge is used for the maintenance, a single-pass image forming device, which includes a plurality of nozzles corresponding to the size of a sheet in the width direction along its side and thus does not require a transfer in the width direction, requires close contact between recording heads having nozzles arranged in the width direction and a suction part and requires accuracy of alignment of the suction part with the nozzles. By contrast, the pressure purge enables an image forming device to perform maintenance more easily. Accordingly, single-pass image forming devices generally use the pressure purge as a maintenance method (e.g., Patent Literatures 1 and 2).

Instead of the maintenance by ink ejection, there is also a method for maintenance which removes air bubbles included in the ink in recording heads by returning the ink, which has been supplied to the recording heads, to an ink supplier reservoir part (i.e., return current maintenance).

PRIOR ART LITERATURES

Patent Literatures

Patent Literature 1: Japanese Unexamined Patent Application Publication No. 2-520

Patent Literature 2: Japanese Unexamined Patent Application Publication No. 2006-116955

DISCLOSURE OF INVENTION

Problems to be Solved by the Invention

By the way, general conventional methods for return current maintenance use pumps to return ink to recording heads through ink flow paths, as ink current return means. The operation of the pumps causes pulsation of the ink. The pulsation of the ink causes meniscus instability on the nozzle plane, and nozzles with the meniscus instability may not eject ink properly. The conventional return current maintenances thus may cause poor image formation due to the meniscus instability on the nozzle plane of recording heads.

In order to reduce the ink pulsation and the impact occurring in ink flow paths which cause the meniscus instability, there is a method of providing dampers constituted of, for example, flexible elastic films on the ink flow paths. Such dampers, however, have low pressure resistance and have a risk of breaking when ink is supplied to recording heads at a high pressure. Increase in pressure resistance of the dampers would impair the ability of the dampers to relax the pulsation. If dampers are used for relaxation of pulsation, the pressure resistance of the dampers limits the pressure for supplying ink to recording heads. This may result in insufficient ink ejection and insufficient return of current.

Various problems caused by the meniscus instability cannot be ignored in the maintenance by ink ejection using the pressure purge.

An object of the present invention is to provide an image forming device and a maintenance method for a recording head which can maintain the recording head through ink ejection and return of ink current by a high pressure without causing meniscus instability on a nozzle plane.

Means for Solving Problems

The invention recited in first aspect is an image forming device including: a recording head including a plurality of nozzles to eject ink onto a recording medium to form an image; a first reservoir part in which the ink to be supplied to the recording head is stored; a supply path connecting the recording head to the first reservoir part, the ink supplied from the first reservoir part passing through the supply path to the recording head; a pressure control unit connected to the first reservoir part, the pressure control unit allowing a pressure in the nozzles of the recording head to be a negative pressure state through the first reservoir part and the supply path; a first switching part to make a switch between opening and closing of a connection between the first reservoir part and the pressure control unit; a second reservoir part in which the ink to be supplied to the first reservoir part is stored; a supply part to supply the ink stored in the second reservoir part to the first reservoir part; a return path connecting the recording head to the second reservoir part, part of the ink which has been supplied to the recording head passing through the return path to return to the second reservoir part; a second switching part to make a switch between opening and closing of the return path; and a control unit to control an operation of each of the first switching part, the second switching part, and the supply part, wherein in a state in which the connection between the first reservoir part and the pressure control unit is closed with the first switching part and the return path is closed with the second switching part, the control unit performs control to operate the supply part so that the ink stored in the second reservoir part is supplied to the first reservoir part to allow the nozzles of the recording head to eject the ink.

The invention recited in second aspect is the image forming device according to first aspect, wherein in a state in which the connection between the first reservoir part and the pressure control unit is closed with the first switching part and the return path is opened with the second switching part, the control unit performs control to operate the supply part so that the ink stored in the second reservoir part is supplied to the first reservoir part to return the ink in the recording head to the second reservoir part.

The invention recited in third aspect is an image forming device including: a recording head including a plurality of nozzles to eject ink onto a recording medium to form an image; a first reservoir part in which the ink to be supplied to the recording head is stored; a supply path connecting the recording head to the first reservoir part, the ink supplied from the first reservoir part passing through the supply path to the recording head; a pressure control unit connected to the first reservoir part, the pressure control unit allowing a pressure in the nozzles of the recording head to be a negative pressure state through the first reservoir part and the supply path; a first switching part to make a switch between opening and closing of a connection between the first reservoir part and the pressure control unit; a second reservoir part in which the ink to be supplied to the first reservoir part is stored; a supply part to supply the ink stored in the second reservoir part to the first reservoir part; a return path connecting the recording head to the second reservoir part, part of the ink which has been supplied to the recording head passing through the return path to return to the second reservoir part; a second switching part to make a switch between opening and closing of the return path; and a control unit to control an operation of each of the first switching part, the second switching part, and the supply part, wherein in a state in which the connection between the first reservoir part and the pressure control unit is closed with the first switching part and the return path is opened with the second switching part, the control unit performs control to operate the supply part so that the ink stored in the second reservoir part is supplied to the first reservoir part to return the ink in the recording head to the second reservoir part.

The invention recited in fourth aspect is the image forming device according to second or third aspect, further including a first heater to heat the ink at the return path, wherein at a time of the control to return the ink in the recording head to the second reservoir part, the control unit controls the first heater in such a way that a temperature of the ink in the return path is higher than a temperature of the ink in the supply path.

The invention recited in fifth aspect is the image forming device according to fourth aspect, further including a second heater to heat the ink at the supply path, wherein the control unit controls the first heater and the second heater in such a way that the temperature of the ink in the supply path and the temperature of the ink in the return path are higher at the time of the control to return the ink in the recording head to the second reservoir part than at a time of image formation.

The invention recited in sixth aspect is the image forming device according to first or second aspect, wherein at a time of the control of ejecting the ink from the nozzles of the recording head, the control unit controls the second switching part to open the return path a predetermined time after the ink stored in the second reservoir part is supplied to the first reservoir part.

The invention recited in seventh aspect is the image forming device according to any one of first to sixth aspects, wherein a phase of the ink changes depending on a temperature thereof.

The invention recited in eighth aspect is the image forming device according to any one of first to seventh aspect, wherein the number of the nozzles corresponds to a maximum width of the recording medium in a direction perpendicular to a direction in which the recording head and the recording medium move relatively to each other at a time of image formation.

The invention recited in ninth aspect is a maintenance method for a recording head of an image forming device, the image forming device including: a recording head including a plurality of nozzles to eject ink onto a recording medium to form an image; a first reservoir part in which the ink to be supplied to the recording head is stored; a supply path connecting the recording head to the first reservoir part, the ink supplied from the first reservoir part passing through the supply path to the recording head; a pressure control unit connected to the first reservoir part, the pressure control unit allowing a pressure in the nozzles of the recording head to be a negative pressure state through the first reservoir part and the supply path; a first switching part to make a switch between opening and closing of a connection between the first reservoir part and the pressure control unit; a second reservoir part in which the ink to be supplied to the first reservoir part is stored; a supply part to supply the ink stored in the second reservoir part to the first reservoir part; a return path connecting the recording head to the second reservoir part, part of the ink which has been supplied to the recording head passing through the return path to return to the second reservoir part; a second switching part to make a switch between opening and closing of the return path; and a control unit to control an operation of each of the first switching part, the second switching part, and the supply part, the method including: closing the connection between the first reservoir part and the pressure control unit with the first switching part; closing the return path with the second switching part; and operating the supply part so that the ink stored in the second reservoir part is supplied to the first reservoir part.

The invention recited in tenth aspect is a maintenance method for a recording head of an image forming device, the image forming device including: a recording head including a plurality of nozzles to eject ink onto a recording medium to form an image; a first reservoir part in which the ink to be supplied to the recording head is stored; a supply path connecting the recording head to the first reservoir part, the ink supplied from the first reservoir part passing through the supply path to the recording head; a pressure control unit connected to the first reservoir part, the pressure control unit allowing a pressure in the nozzles of the recording head to be a negative pressure state through the first reservoir part and the supply path; a first switching part to make a switch between opening and closing of a connection between the first reservoir part and the pressure control unit; a second reservoir part in which the ink to be supplied to the first reservoir part is stored; a supply part to supply the ink stored in the second reservoir part to the first reservoir part; a return path connecting the recording head to the second reservoir part, part of the ink which has been supplied to the recording head passing through the return path to return to the second reservoir part; a second switching part to make a switch between opening and closing of the return path; and a control unit to control an operation of each of the first switching part, the second switching part, and the supply part, the method including: closing the connection between the first reservoir part and the pressure control unit with the first switching part; opening the return path with the second switching part; and operating the supply part so that the ink stored in the second reservoir part is supplied to the first reservoir part.

Effects of the Invention

The present invention can maintain a recording head through ink ejection and return of ink current by a high pressure without causing meniscus instability on a nozzle plane.

BEST MODE TO CARRY OUT THE INVENTION

An image forming device 1, which is an embodiment of the present invention, is described below in detail with reference to the drawings. The embodiment is an example of the present invention, and the present invention is not limited to the embodiment.

Figure 1:
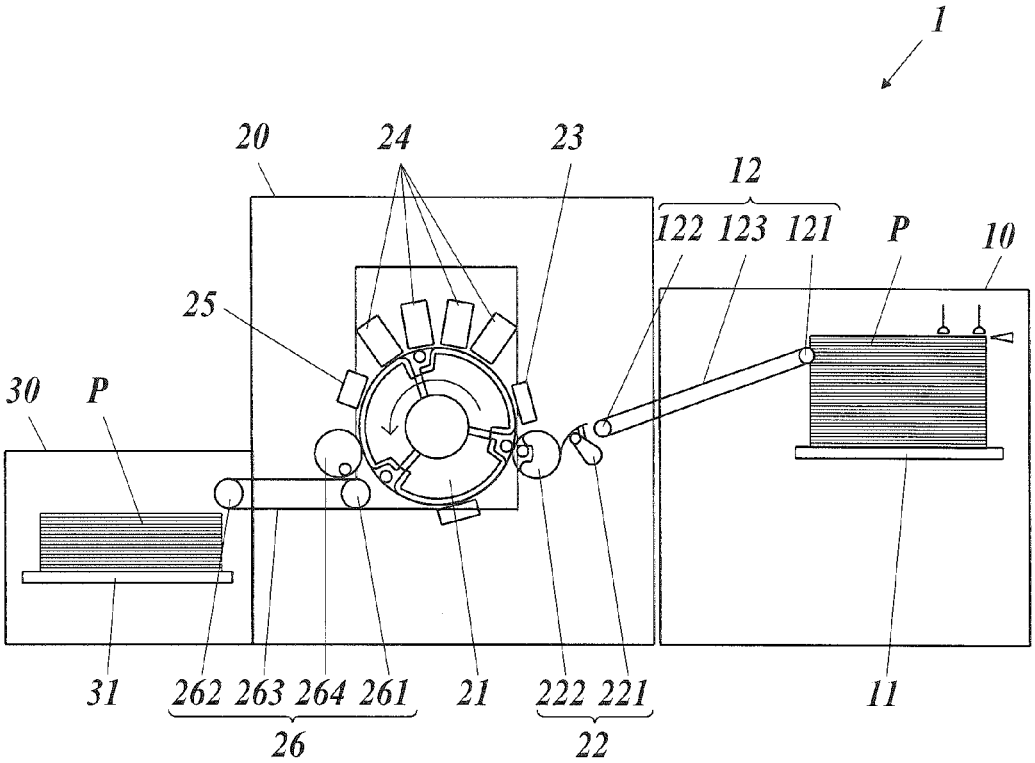
FIG. 1 is diagram showing the main configuration of an image forming device of an embodiment of the present invention.

FIG. 1 is diagram showing the main configuration of the image forming device 1 of an embodiment of the present invention.

Figure 8:
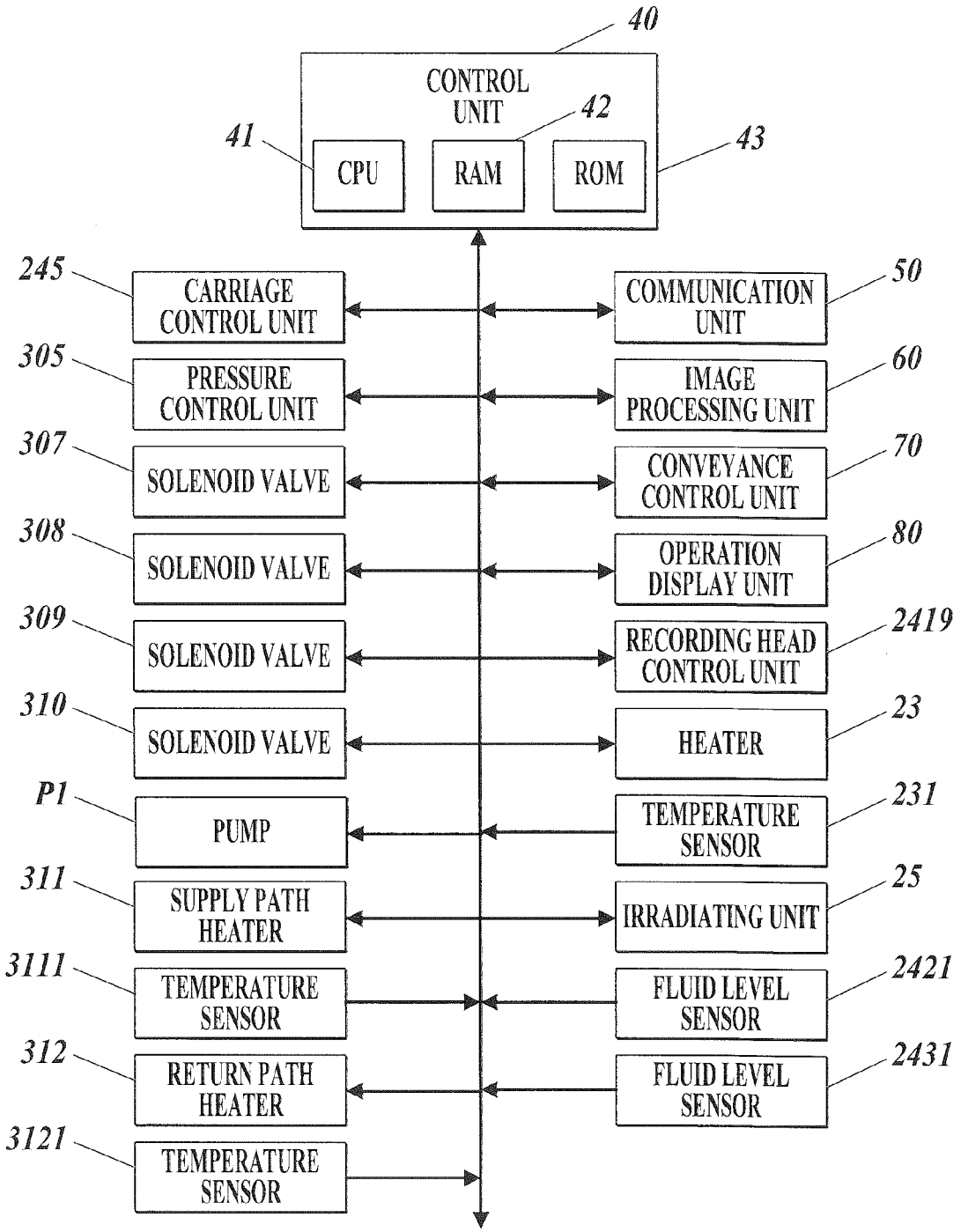
FIG. 8 is a block diagram of an image forming device.

The image forming device 1 includes a paper feeding unit 10, an image forming unit 20, a paper output unit 30, and a control unit 40 (see FIG. 8). The image forming device 1 conveys recording media P stored in the paper feeding unit 10 to the image forming unit 20, forms images on the recording media P in the image forming unit 20, and outputs the recording media, on which images have been formed, to the paper output unit 30, under the control of the control unit 40.

The paper feeding unit 10 includes a paper feeding tray 11 to store recording media P, and a conveying unit 12 to convey recording media P from the paper feeding tray 11 to the image forming unit 20.

The paper feeding tray 11 is a plate member on which one or more recording media P can be placed. The paper feeding tray 11 moves up and down in accordance with the number of recording media P placed on the paper feeding tray 11, and is held at a position to allow the conveying unit 12 to convey the topmost recording medium P, with respect to the up-and-down motion direction.

The conveying unit 12 includes a conveying mechanism to drive a looped belt 123, whose inner face is supported by a plurality of (e.g., two) rollers 121 and 122, to convey recording media P on the belt 123; and a supplying unit to deliver the topmost recording medium P, placed over the paper feeding tray 11, to the belt 123. The conveying unit 12 conveys a recording medium P, which has been delivered by the supplying unit to the belt 123, along the belt 123.

The image forming unit 20 includes an image forming drum 21 to support a recording medium P along its cylindrical outer periphery; a passing unit 22 to pass a recording medium, which has been conveyed by the conveying unit 12 of the paper feeding unit 10, to the image forming drum 21; a heater 23 to heat a recording medium P held on the image forming drum 21; head units 24 to eject ink onto a recording medium P held on the image forming drum. 21 to form an image; an irradiating unit 25 to emit energy rays for curing ink ejected onto a recording medium P; a delivering unit 26 to deliver a recording medium P, which has been irradiated by the irradiating unit 25, from the image forming drum 21 to the paper output unit 30; and a cleaning unit 27 (see FIG. 4) to receive ink ejected from the head units 24 at the time of maintenance of the head units 24.

Figure 2:
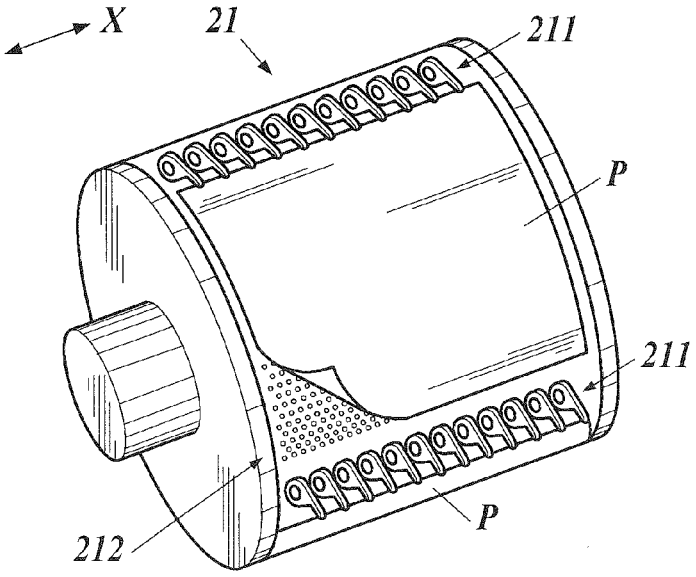
FIG. 2 is a perspective view of an image forming drum.

FIG. 2 is a perspective view of the image forming drum 21.

The image forming drum 21 includes nail parts 211 and a suction part 212 to hold a recording medium P on the outer periphery of the image forming drum 21.

With reference to FIG. 2, each nail part 211 includes a plurality of nails arranged in the direction of the rotation axis (X direction) of the cylindrical image forming drum 21 at a predetermined position on the outer periphery of the image forming drum 21. Each nail part 211 catches a part near one side of a recording medium P in cooperation with the outer periphery of the image forming drum 21 to hold the recording medium P.

The suction part 212 includes a plurality of suction holes (as shown in FIG. 2) and a not-shown suction generating part (e.g., an air pump or fan). The suction holes are disposed in the outer periphery of the image forming drum 21, on which a recording medium P is held while a part near one side of the recording medium P is caught by a nail part 211. The suction generating part generates suction force to suck gas into the image forming drum 21 through the suction holes. Specifically, the suction part 212 allows a recording medium P to stick to the outer periphery of the image forming drum 21 so as to lie along the outer periphery with the suction force generated by suction through the suction holes.

In FIG. 2 and later-described FIG. 4, a part of the recording medium P is turned up from the outer periphery of the image forming drum 21 for the purpose of showing the suction holes. In reality, however, an entire recording medium P is held on the outer periphery of the image forming drum 21 so as to lie along the outer periphery at the time of image formation by the image forming unit 20.

The passing unit 22 is disposed between the conveying unit 12 of the paper feeding unit 10 and the image forming drum 21. The passing unit 22 includes a nail part 221 to catch one end of a recording medium P which has been conveyed by the conveying unit 12, and a cylindrical passing drum 222 to guide a recording medium P caught with the nail part 221. The passing unit 22 takes in a recording medium P from the conveying unit 12 with the nail part 221 and puts the recording medium P along the outer periphery of the passing drum 222. The passing unit 22 thus leads the recording medium P to lie in such an orientation as to be put along the outer periphery of the image forming drum 21 and delivers the recording medium P to the image forming drum 21.

The heater 23 includes, for example, a heating wire, and produces heat in accordance with applied current. The heater 23 is disposed near the outer periphery of the image forming drum 21 and upstream of the head units 24 in the direction in which a recording medium P is conveyed by the rotation of the image forming drum 21. The control unit 40 controls the heat generation of the heater 23 so that a recording medium P, which is held by the image forming drum 21 and passing by the heater 23, is heated to a predetermined temperature.

A temperature sensor 231 is disposed near the heater 23. The control unit 40 controls the operation of the heater 23 on the basis of the temperature of the vicinity of the heater 23 detected by the temperature sensor 231 so that a recording medium. P, which is held by the image forming drum. 21 and passing by the heater 23, is heated to a predetermined temperature.

Figure 3A:
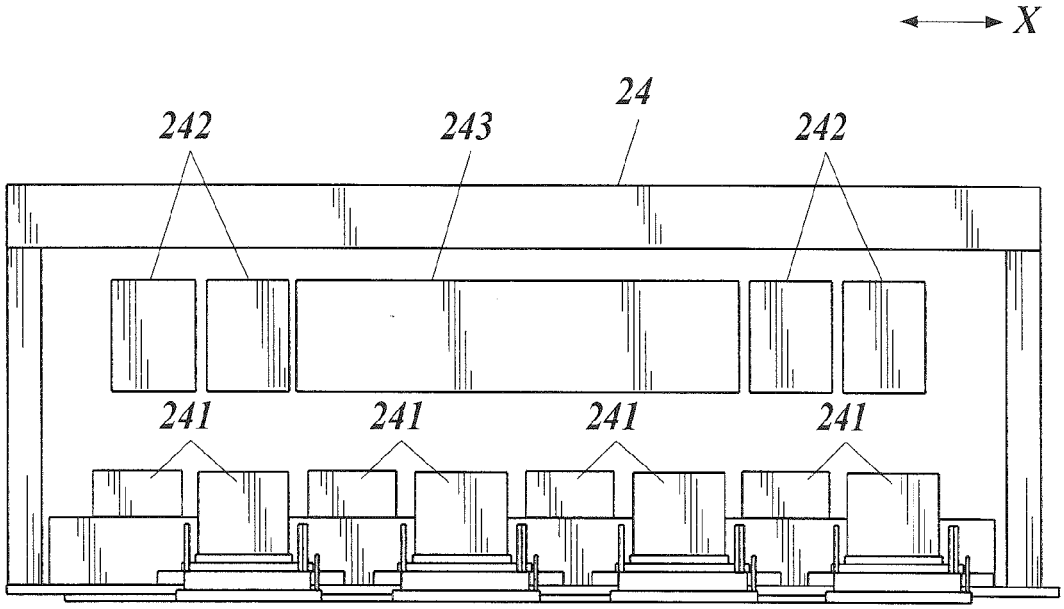
FIG. 3A is a schematic diagram of the internal configuration of a head unit viewed from the side.
Figure 3B:
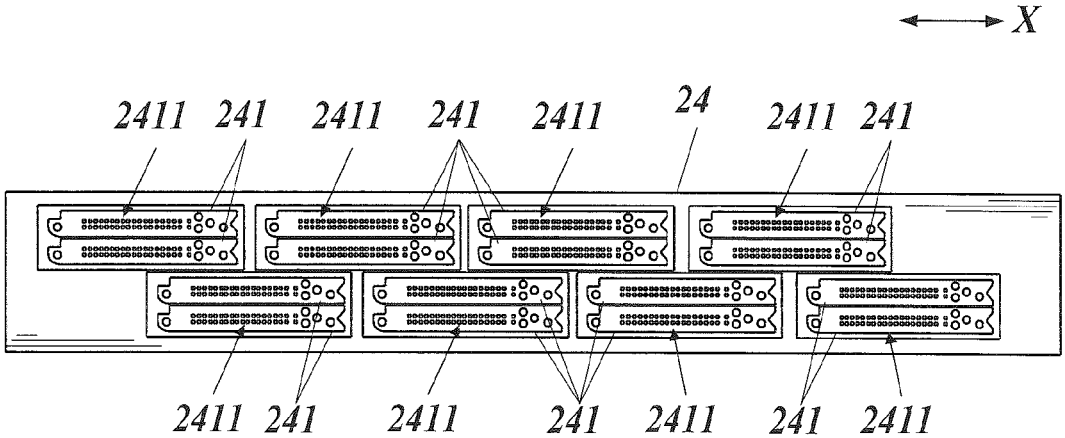
FIG. 3B is a schematic diagram of the internal configuration of a head unit viewed from above.

FIG. 3 is diagrams showing the internal configuration of a head unit 24. FIG. 3A is a schematic diagram of the internal configuration, seen from the side, of the head unit 24. FIG. 3B is a schematic diagram of the internal configuration, seen from the above, of the head unit 24. In connection with the term "above" used here, the side of one surface (or undersurface) of the head unit 24 facing the outer periphery of the image forming drum 21 is "below the head unit 24". The case in which the head unit 24 is viewed from the side means the case in which the head unit 24 is viewed assuming that one lateral face along the top/bottom direction and the X direction of the head unit 24 is the front face.

The head units 24 are disposed at a predetermined distance from the image forming drum 21 along the outer periphery of the image forming drum 21.

With reference to FIGS. 3A and 3B, each head unit 24 includes a plurality of recording heads 241.

Each of the recording heads 241 has a plurality of nozzles 2411. The recording heads 241 eject ink through the nozzles 2411 to form an image on a recording medium P held on the image forming drum 21. Specifically, the nozzles 2411 of the recording heads 241 are exposed on the lower sides of the head units. The recording heads 241 shown in FIG. 3B each have a plurality of nozzles 2411 arranged in such a way that two nozzle rows extend in the X direction.

With reference to FIG. 3B, for example, the recording heads 241 are arranged in pairs in such a way that the pairs of the recording heads 241 form a plurality of rows of the recording heads 241 extending in the X direction. The positional relationships of the pairs of the recording heads 241 in adjacent rows are such that the pairs are arranged in a staggered fashion in the direction perpendicular to the X direction.

Figure 4:
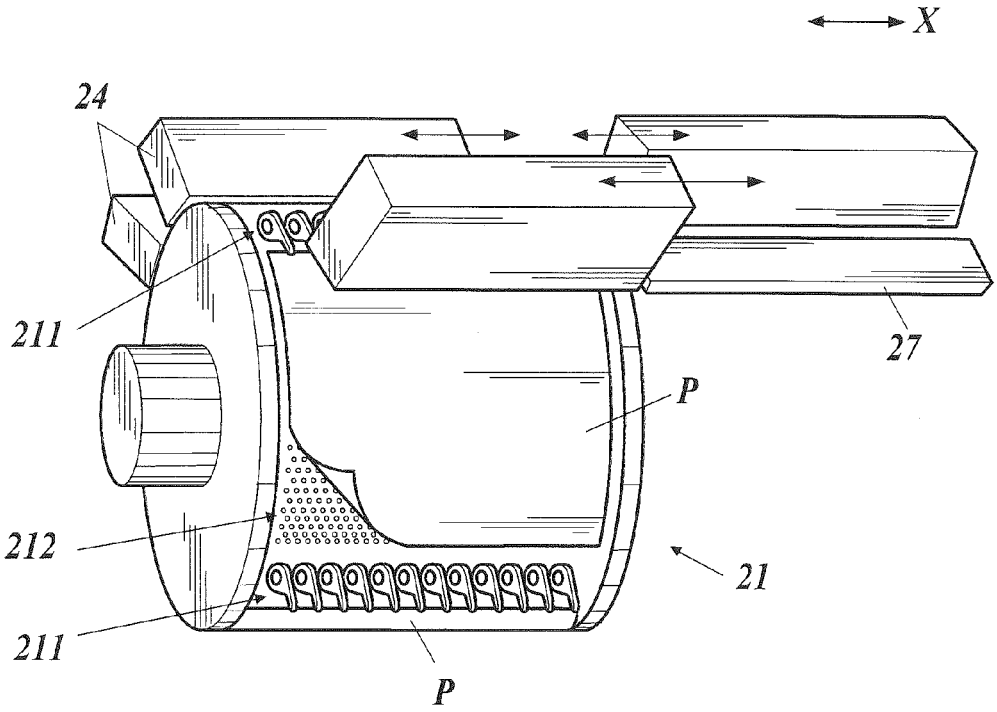
FIG. 4 is a perspective view showing the positional relationship between an image forming drum and a cleaning unit, and the positions of a head unit before and after being moved.

FIG. 4 is a perspective view showing the positional relationship between the image forming drum. 21 and the cleaning unit 27, and showing the positions of a head unit 24 before and after being moved.

Each of the head units 24 can move individually along the X direction. Specifically, with reference to FIG. 4, each head unit 24 can move between the image forming drum 21 and the cleaning unit 27 disposed to be adjacent to each other in the X direction. The head unit 24 moves to the position such that the lower surface of the head unit 24 faces the image forming drum 21 at the time of image formation, and moves to the position such that the lower surface faces the cleaning unit 27 at the time of various kinds of maintenance, described later, under the control of the control unit 40. The movements of the head units 24 are controlled by a carriage control unit 245, described later.

The head unit 24 is individually provided for each of the colors (CMYK) used for image formation. The image forming device 1 shown in FIGS. 1 and 4 has the head units 24 for the colors of Y, M, C, K, respectively, in this order from upstream in the direction in which a recording medium P is conveyed by the rotation of the image forming drum 21.

With reference to FIG. 4, each head unit 24 has an X-direction width wide enough to cover the X-direction width of a recording medium P to be held and conveyed by the image forming drum 21. At the time of image formation, the positions of the head units 24 are fixed relative to the position of the image forming drum 21. Specifically, the image forming device 1 is a single-pass inkjet image forming device, where the number of the nozzles 2411 of the recording heads 241 arranged in the X direction on each head unit 24 corresponds to the maximum width of a recording medium P in the direction (i.e., X direction) perpendicular to the direction in which the recording heads 241 and the recording medium P move relatively to each other at the time of image formation.

Description of ink is given below.

The ink used for the image formation by the image forming device 1 has a property of changing phase depending on the temperature of the ink.

Specifically, the ink changes phase between gel or solid and liquid depending on its temperature. Such ink contains composition mainly composed of polymerizable compound and photopolymerization initiator with a several percent of gelling agent added, for example.

An example process for manufacturing the ink is disclosed below.

A mixture of 5 parts by mass of SOLSPERSE 32000 (Lubrizol Corporation) and 80 parts by mass of HD-N (1,6-hexanediol dimethacrylate: Shin-Nakamura Chemical Co., Ltd.) is heated and stirred in a stainless steel beaker to be dissolved. The mixture is then cooled to room temperature. And then, 15 parts by mass of Carbon Black (#56, Mitsubishi Chemical Corporation) is added to the mixture, which is then put in a sealed glass vial with zirconia beads of 0.5 mm. Dispersion of the mixture is performed with a paint shaker for 10 hours, and the zirconia beads are then removed therefrom. The product is obtained as a pigment dispersion element.

The compositions are adjusted as illustrated in Tables 1 to 6, including the pigment dispersion element obtained as described above.

TABLE 1

| | NAME | MANUFACTURER | AMOUNT (PART) |
|---|---|---|---|
| POLYMERIZABLE COMPOUND | A-600 | SHIN-NAKAMURA CHEMICAL CO., LTD. | 50 |
| POLYMERIZABLE COMPOUND | A-GLY-9E | SHIN-NAKAMURA CHEMICAL CO., LTD. | 5 |
| POLYMERIZABLE COMPOUND | HD-N | SHIN-NAKAMURA CHEMICAL CO., LTD. | 4.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 2

| | NAME | MANUFACTURER | AMOUNT (PART) |
|---|---|---|---|
| POLYMERIZABLE COMPOUND | 9G | SHIN-NAKAMURA CHEMICAL CO., LTD. | 35 |
| POLYMERIZABLE COMPOUND | U-200PA | SHIN-NAKAMURA CHEMICAL CO., LTD. | 5 |
| POLYMERIZABLE COMPOUND | 3G | SHIN-NAKAMURA CHEMICAL CO., LTD. | 19.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | DAROCUR TPO | BASF | 3 |
| PHOTOPOLYMERIZATION INITIATOR | PROCURE TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 3

| | NAME | MANUFACTURER | AMOUNT (PART) |
|---|---|---|---|
| POLYMERIZABLE COMPOUND | 14G | SHIN-NAKAMURA CHEMICAL CO., LTD. | 45 |
| POLYMERIZABLE COMPOUND | A-HD-N | SHIN-NAKAMURA CHEMICAL CO., LTD. | 14.85 |
| PIGMENT DISPERSION ELEMENT | | | 20 |

TABLE 3-continued

| | NAME | MANUFACTURER | AMOUNT (PART) |
|---|---|---|---|
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 4

| | NAME | MANUFACTURER | AMOUNT (PART) |
|---|---|---|---|
| POLYMERIZABLE COMPOUND | UA-4200 | SHIN-NAKAMURA CHEMICAL CO., LTD. | 35 |
| POLYMERIZABLE COMPOUND | A-HD-N | SHIN-NAKAMURA CHEMICAL CO., LTD. | 24.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 5

| | NAME | MANUFACTURER | AMOUNT (PART) |
|---|---|---|---|
| POLYMERIZABLE COMPOUND | AD-TMP | SHIN-NAKAMURA CHEMICAL CO., LTD. | 30 |
| POLYMERIZABLE COMPOUND | A-GLY-9E | SHIN-NAKAMURA CHEMICAL CO., LTD. | 20 |
| POLYMERIZABLE COMPOUND | HD-N | SHIN-NAKAMURA CHEMICAL CO., LTD. | 9.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 6

| | NAME | MANUFACTURER | AMOUNT (PART) |
|---|---|---|---|
| POLYMERIZABLE COMPOUND | U-200PA | SHIN-NAKAMURA CHEMICAL CO., LTD. | 13 |
| POLYMERIZABLE COMPOUND | A-GLY-9E | SHIN-NAKAMURA CHEMICAL CO., LTD. | 5 |
| POLYMERIZABLE COMPOUND | HD-N | SHIN-NAKAMURA CHEMICAL CO., LTD. | 41.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

The compositions shown in Tables 1 to 6 are each filtered with a 3-μm membrane filter of Teflon (registered trademark) manufactured by ADVANTEC. The compositions after the filtering are obtained as inks.

Figure 5:
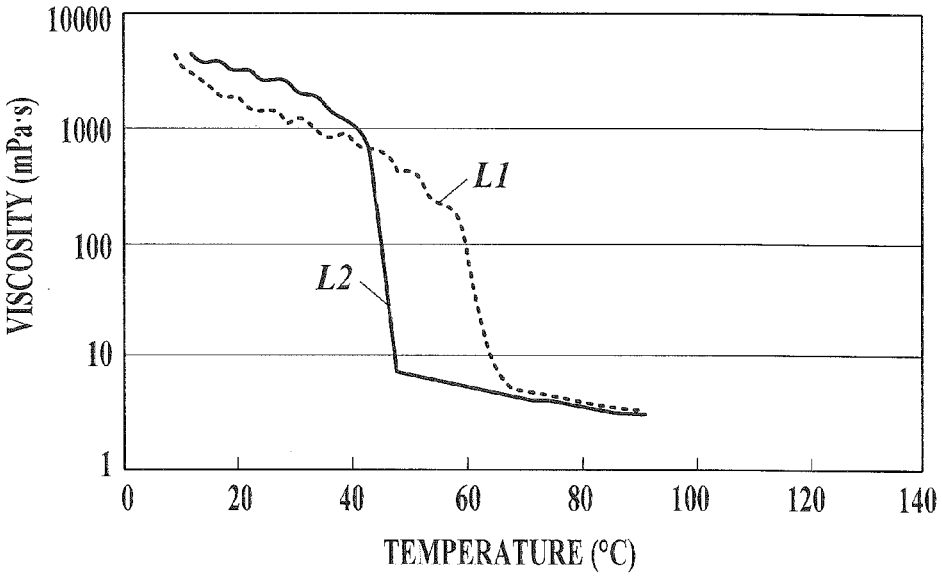
FIG. 5 is a graph showing example changes in ink viscosity in response to the increase and decrease in ink temperature.

FIG. 5 shows example changes in ink viscosity according to the increase and decrease in ink temperature. In FIG. 5, the line L1 represents an example change in ink viscosity in response to temperature increase, and the line L2 represents an example change in ink viscosity in response to temperature decrease.

As indicated by the line L1 of FIG. 5, the ink exhibits a phase transition or a significant change in viscosity at or around 60° C. at the time of temperature increase. Specifically, the ink, which is in a gel or solid state when it is below 60° C., is significantly reduced in viscosity to become liquid when the temperature is increased to 60° C. or a little above 60° C.

As indicated by the line L2 of FIG. 5, the ink exhibits a phase transition or a significant change in viscosity at or around 45° C. at the time of temperature decrease, the degree of the change in viscosity being larger than at the time of temperature increase. Specifically, the ink, which is kept in a liquid state until its temperature is 45° C. or a little above 45° C., is significantly increased in viscosity to become gel or solid when the temperature is decreased to 45° C. or a little below 45° C.

Ink is stored in, for example, first reservoir parts 242 and second reservoir parts 243 in the head units 24. The mechanism to supply ink from the first reservoir parts 242 and the second reservoir parts 243 to the recording heads 241 is described later.

The irradiating unit 25 includes a fluorescent tube, such as a low-pressure mercury lamp. The fluorescent tube emits light to provide energy rays, such as ultraviolet rays. The irradiating unit 25 is disposed near the outer periphery of the image forming drum 21 and downstream of the head units 24 in the direction in which a recording medium P is conveyed by the rotation of the image forming drum 21. The irradiating unit 25 irradiates, with energy rays, a recording medium P which is held on the image forming drum 21 and on which ink has been ejected. The energy rays cure the ink on the recording medium P.

The fluorescent tube to emit ultraviolet rays is not limited to a low-pressure mercury lamp but may be a mercury lamp having an operating pressure from several hundred Pa to 1 MPa, a light source to be used as a germicidal lamp, a cold-cathode tube, an ultraviolet laser source, a metal halide lamp, and a light-emitting diode, for example. A light source which can emit ultraviolet rays at high intensity and consumes less power (e.g., a light-emitting diode) is preferred. The energy rays are not limited to ultraviolet rays but may be any other energy rays that have the property of curing ink according to the type of ink. A light source is replaced in accordance with energy rays.

The delivering unit 26 includes a conveying mechanism to drive a looped belt 263, whose inner face is supported by a plurality of (e.g., two) rollers 261 and 262, to convey a recording medium P on the belt 263; and a cylindrical passing roller 264 to deliver a recording medium P from the image forming drum 21 to the conveying mechanism. The delivering unit 26 conveys a recording medium P, which has been delivered by the passing roller 264 to the belt 263, along the belt 263 to send the recording medium P to the paper output unit 30.

The cleaning unit 27 includes a waste ink part (not shown) to receive and store ink ejected from the head units 24 at the time of maintenance. The cleaning unit 27 prevents the image forming unit 20 from being dirtied by the ink ejected from the head units 24 at the time of maintenance.

The paper output unit 30 includes a plate paper output tray 31 on which recording media P sent from the image forming unit 20 by the delivering unit 26 are placed. Recording media P on which images have been formed are held on the paper output unit 30 until picked up by a user.

Next, an ink ejecting mechanism 300 is described. The ink ejecting mechanism 300 refers to a mechanism related to the operation for ink ejection from the nozzles 2411 of the recording heads 241, and includes a system to supply ink from the first reservoir parts 242 and the second reservoir parts 243 to the recording heads 241.

Figure 6:
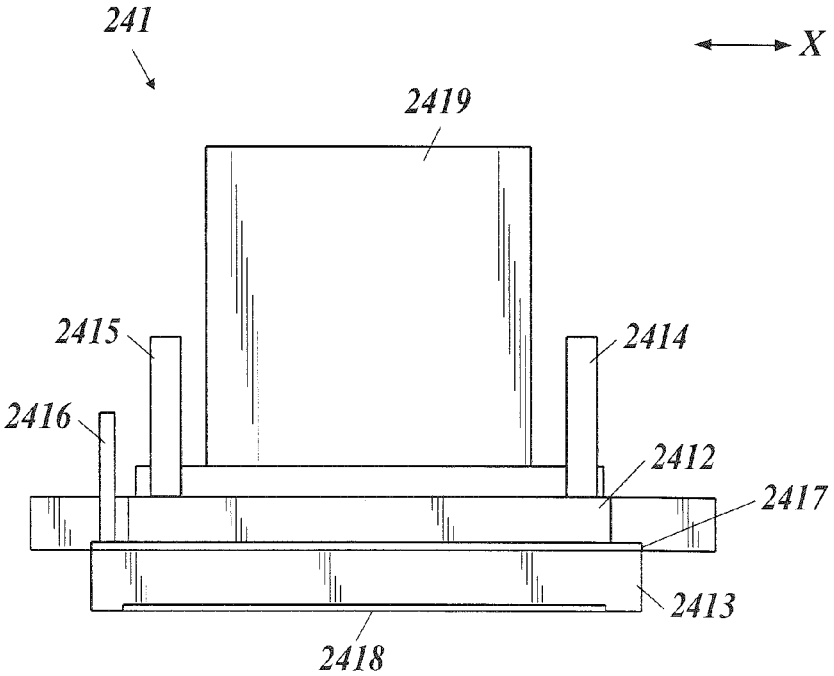
FIG. 6 is a side view of a recording head.

FIG. 6 is a side view of a recording head 241. The term "side" refers to a lateral face of the head unit 24.

Figure 7:
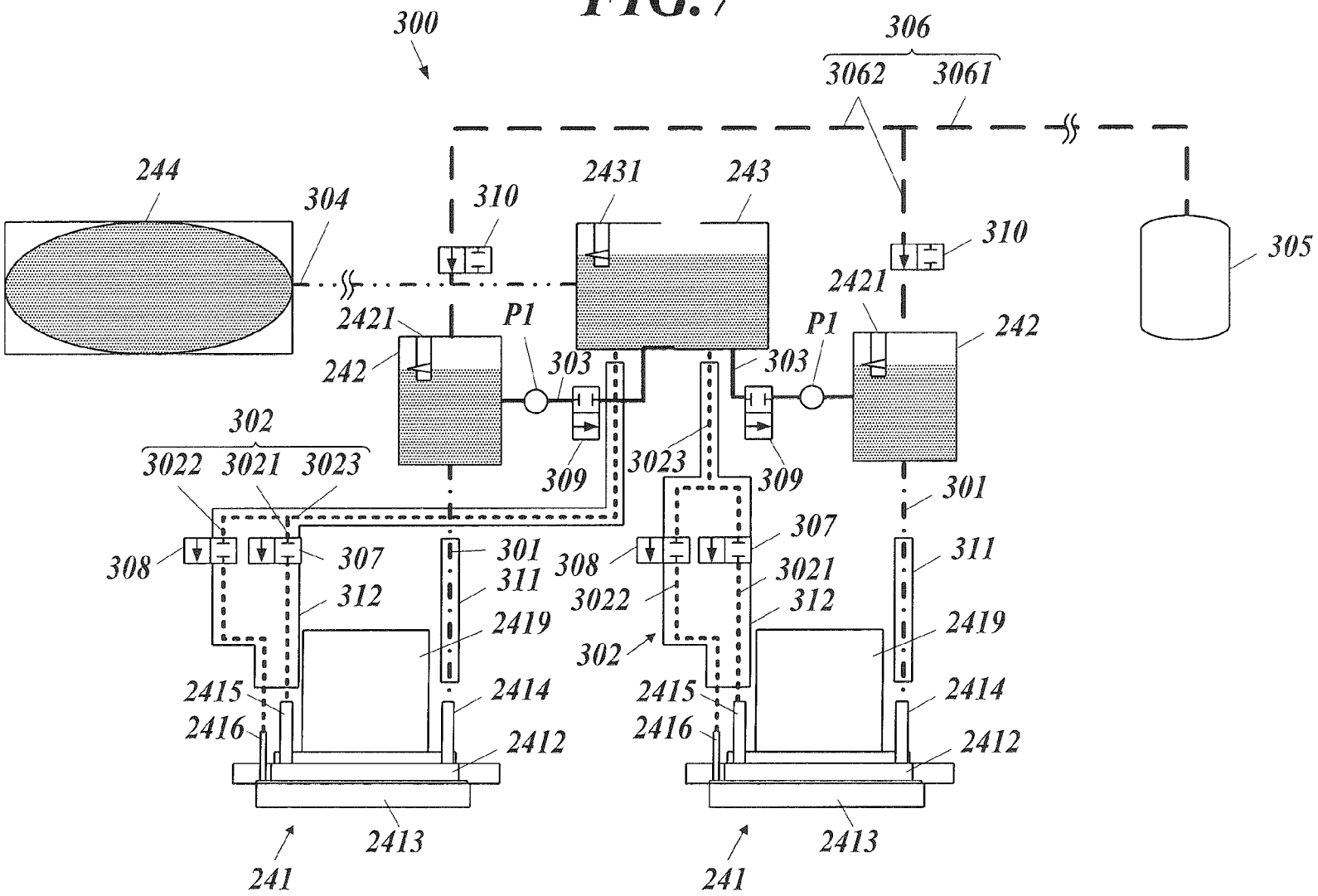
FIG. 7 is a schematic diagram showing the main configuration of an ink ejecting mechanism and the connections between the parts of the ink ejecting mechanism.

With reference to FIGS. 7 and 6, each of the recording heads 241 includes an upper flow path section 2412 and a lower flow path section 2413 which serve as flow paths of ink to be ejected from the recording head 241, an inlet 2414 through which ink is supplied to the upper and lower flow path sections 2412 and 2413, an outlet 2415 through which the ink flows to return from the upper flow path section 2412 to the second reservoir part, and a bypass 2416 through which the ink flows to return from the lower flow path section 2413 to the second reservoir part.

Each of the upper and lower flow path sections 2412 and 2413 contains a flow path to lead the ink to be supplied to the nozzles of the recording head 241 to the nozzles. The flow paths, which are common flow paths shared by a plurality of nozzles, lead the ink flowing in through the inlet 2414. Specifically, the ink supplied through the inlet 2414 flows through the flow paths of the upper and lower flow path sections 2412 and 2413 to the nozzles 2411.

The common flow path in the upper flow path section 2412 is also connected to the outlet 2415. In other words, the ink flowing through the upper flow path section 2412 can also flow out through the outlet 2415. The common flow path in the lower flow path section 2413 is also connected to the bypass 2416. In other words, the ink flowing through the lower flow path section 2413 can also flow out through the bypass 2416.

A filter 2417 is provided between the upper flow path section 2412 and the lower flow path section 2413. The filter 2417 filters the ink flowing from the upper flow path section 2412 to the lower flow path section 2413.

A pressure chamber 2418 is provided around the nozzle plane at the bottom of the lower flow path section 2413. The pressure chamber 2418 applies pressure to the nozzles corresponding to the ink to be ejected in accordance with an image to be formed on a recording medium P, under the control of the control unit 40.

Each of the recording heads 241 includes a recording head control unit 2419. The recording head control unit 2419 is disposed at the upper part of the upper flow path section 2412, for example, and controls the operation of the pressure chamber 2418 under the control of the control unit 40.

FIG. 7 is a schematic diagram showing the main configuration of the ink ejecting mechanism 300 and the connections between the parts of the ink ejecting mechanism 300. Although the pathways of ink are indicated by broken lines in FIG. 7 etc., the pathways represented by these broken lines are actually continuous pathways to allow ink to flow.

With reference to FIG. 7, each first reservoir part 242 is connected to the inlet 2414 of a recording head 241 with a supply path 301.

The recording heads 241 are connected to the second reservoir part 243 with return paths 302. Each of the return paths 302 is configured in such a way that two return paths, i.e., a first return path 3021 and a second return path 3022 connected to the outlet 2415 and the bypass 2416, respectively, of a recording head 241, joins together into a common return path 3023 which is connected to the second reservoir part 243.

Each of the first reservoir parts 242 is connected to the second reservoir part 243 with a path 303 provided with a pump P1. The pump P1 serves as a supply part to supply the ink stored in the second reservoir part 243 to the first reservoir part 242. Examples of the pumps P1 include positive-displacement pumps, such as diaphragm pumps, and tube pumps. Each pump P1 operates under the control of the control unit 40.

An ink tank 244 is connected to the second reservoir part 243. The ink tank 244 stores ink to be supplied to the second reservoir part 243. The second reservoir part 243 and the ink tank 244 are connected to each other with a path 304 provided with a pump (not shown). Ink is supplied from the ink tank 244 to the second reservoir part 243 in accordance with the operation of the pump under the control of the control unit 40.

The supply paths 301, the return paths 302, and the paths 303 and 304, which are tube members through which ink passes, are made of material such as resin or a highly heat-conductive material.

The first reservoir parts 242 are connected to a pressure control unit 305. The pressure control unit 305 connected to the first reservoir parts 242 brings the nozzles of the recording heads 241 into a negative pressure state through the first reservoir parts 242 and the supply paths 301. The ink is thus prevented from dropping out of the nozzles when image formation and various kinds of maintenance are not performed.

The first reservoir parts 242 are connected to the pressure control unit 305 through an airflow path 306. The airflow path 306 is a tube member through which air passes, and is made of material such as resin. In other words, the pressure control unit 305 changes the air pressure in the first reservoir parts 242 under the control of the control unit 40.

The airflow path 306 is configured in such a way that a common airflow path 3061 connected to the pressure control unit 305 branches into a plurality of branching airflow paths 3062 connected to the respective first reservoir parts 242.

The first return path 3021, the second return path 3022, the path 303, and the branching airflow path 3062 are provided with solenoid valves 307, 308, 309, and 310, respectively. Each of the solenoid valves 307, 308, 309, and 310 opens and closes the ink flow path or airflow path on which the valve is provided under the control of the control unit 40. Specifically, the solenoid valve 310 provided on each branching airflow path 3062 serves as a first switching part to make a switch between opening and closing of the connection between the first reservoir part 242 and the pressure control unit 305. The solenoid valve 307 provided on each first return path 3021 and the solenoid valve 308 provided on each second return path 3022 serve as a second switching part to make a switch between opening and closing of the return path 302.

The solenoid valve 309 on each path 303, on which a pump P1 is provided, is disposed between the second reservoir part 243 and the pump P1.

Each of the supply paths 301 is provided with a supply path heater 311.

The supply path heater 311 includes a heating wire, for example, and produces heat in accordance with applied current. The supply path heater 311 serves as a second heater to heat the supply path 301 so as to heat the ink passing through the supply path 301.

Each of the supply paths 301 is provided with a temperature sensor 3111. The control unit 40 controls the operation of each supply path heater 311 on the basis of the temperature around the supply path 301 detected by the temperature sensor 3111.

Each of the return paths 302 is provided with a return path heater 312.

The return path heater 312 includes a heating wire, for example, and produces heat in accordance with applied current. The return path heater 312 serves as a first heater to heat the return path 302 so as to heat the ink passing through the return path 302.

Each of the return paths 302 is provided with a temperature sensor 3121. The control unit 40 controls the operation of each return path heater 312 on the basis of the temperature around the return path 302 detected by the temperature sensor 3121.

Each of the first reservoir parts 242 is a tank container hermetically sealed except the parts for the connections described above. Specifically, the pressure in the first reservoir part 242 varies depending on the degree of negative pressure applied by the pressure control unit 305 and depending on whether ink is supplied from the second reservoir part 243. For example, when ink is supplied from the second reservoir part 243 while the solenoid valve 310 is closed and no negative pressure is applied by the pressure control unit 305, the amount of ink in the first reservoir part 242 increases, leading to an increase in pressure in the first reservoir part 242.

The second reservoir part 243, which is a container open up to the outside, is kept substantially at atmospheric pressure regardless of increase and decrease in ink amount therein.

FIG. 8 is a block diagram of the image forming device 1.

The control unit 40 includes a CPU 41, a RAM 42, and a ROM 43.

The CPU 41 reads out various programs and data, according to processing, from a storage unit such as the ROM 43 to execute the read-out programs and data. The CPU 41 controls the operation of each unit of the image forming device 1 in accordance with the executed processing. The RAM 42 temporarily stores various programs and data to be processed by the CPU 41. The ROM 43 stores various programs and data to be read out by the CPU 41, for example.

With reference to FIG. 8, the control unit 40 is connected to each of the units of the image forming device 1 to control the operation of the connected units. The control unit 40 controls the operation of the image forming device 1 in accordance with the input/output of data from/to the units.

The control unit 40 performs processing in accordance with the input provided from a user through an operation display unit 80 including a touch panel, for example. The control unit 40 allows the operation display unit 80 to provide various types of display for the operation of the image forming device 1.

The control unit 40 obtains image data included in a print job through a communication unit 50. The communication unit 50 allows connection of the image forming device 1 to an external device for communication between them and receives data of print job, for example, from the external device.

The control unit 40 allows an image processing unit 60 to perform various types of image processing on the image data obtained through the communication unit 50. Examples of the image processing to be performed by the image processing unit 60 include, but are not limited to, analyzing processing and rasterizing processing.

The control unit 40 controls the operation of each unit related to the conveyance of recording media P, such as the paper feeding unit 10 and the image forming unit 20, through the conveyance control unit 70 in response to the instructions for image formation from an external device upon transmission of a print job. The conveyance control unit 70 is connected to the units related to the conveyance and support of recording media P, such as the conveying unit 12, the image forming drum 21, the passing unit 22, and the delivering unit 26, to control the operations of the units, although not shown in the drawing.

The control unit 40 controls the carriage control unit 245 to control the positions of the head units 24. At the time of image formation, the control unit 40 disposes the head units 24 over the image forming drum 21. The carriage control unit 245 is connected to a driving unit (not shown) to move the head units 24 in the X direction. The carriage control unit 245 controls the operation of the driving unit to change or keep the positions of the head units 24.

The control unit 40 performs overall control of the operation of the recording head control unit 2419 to control ink ejection from the nozzles by the pressures from the pressure chambers 2418. In other words, the control unit 40 controls the operations of the recording heads 241 in accordance with the image to be formed on a recording medium P on the basis of image data.

The control unit 40 operates the heater 23 and the irradiating unit 25 at the time of image formation.

At the time of image formation, the control unit 40 operates the pressure control unit 305 and opens the airflow path 306 with the solenoid valves 310. Further, the control unit 40 closes the return paths 302 with the solenoid valves 307 and 308 at the time of image formation.

At the time of image formation, when ink is ejected from the nozzles 2411 of the recording heads 241 and the amount of ink stored in the first reservoir parts 242 and the second reservoir parts 243 is reduced, the control unit 40 performs control so as to supply ink to the first reservoir parts 242 and the second reservoir parts 243 to secure the amount of ink in the first reservoir parts 242 and the second reservoir parts 243.

Specifically, when the control unit 40 obtains the remaining amount of ink in a first reservoir part 242 and a second reservoir part 243 detected by fluid level sensors 2421 and 2431 disposed in the first and second reservoir parts 242 and 243, respectively, and the obtained remaining amount of ink is below a predetermined remaining amount set for each reservoir part, the control unit 40 operates the pump disposed between the ink tank 244 and the second reservoir part 243, and the pump P1 disposed between the second reservoir part 243 and the first reservoir part 242, to supply ink to the first reservoir part 242 and the second reservoir part 243.

The control unit 40 performs control to close the paths 303 with the solenoid valves 309 when the pumps P1 are not operated, open the paths 303 before starting operation of the pumps P1, and close again the paths 303 after completing operation of the pumps P1.

The ink tank 244, the first reservoir parts 242, and the second reservoir part 243 are each provided with a heater (not shown) to maintain the ink at a predetermined temperature for image formation (e.g., about 75 to 80° C.). The heaters are operated under the control of the control unit 40.

Next, the behavior of the image forming device 1 at the time of maintenance of the recording heads 241 is described.

The maintenances of the recording heads 241 of the image forming device 1 include ejection maintenance and return current maintenance.

The ejection maintenance aims to remove clogging of the nozzles 2411 of the recording heads 241 through ink ejection from the nozzles 2411.

The return current maintenance aims to sweep air bubbles away included in the ink in the recording heads 241 to remove the air bubbles from the recording heads 241 by returning ink from the recording heads 241 to the second reservoir parts 243. The air bubbles in the ink expelled from the recording heads 241 are washed to the second reservoir parts 243, released under the atmospheric pressure, and disappear.

The control unit 40 can perform each of the ejection maintenance and the return current maintenance individually for each head unit 24, and further, individually for each of a plurality of recording heads 241. Alternatively, the control unit 40 can perform each of the maintenances simultaneously for a plurality of head units 24 and a plurality of recording heads 241.

Figure 9:
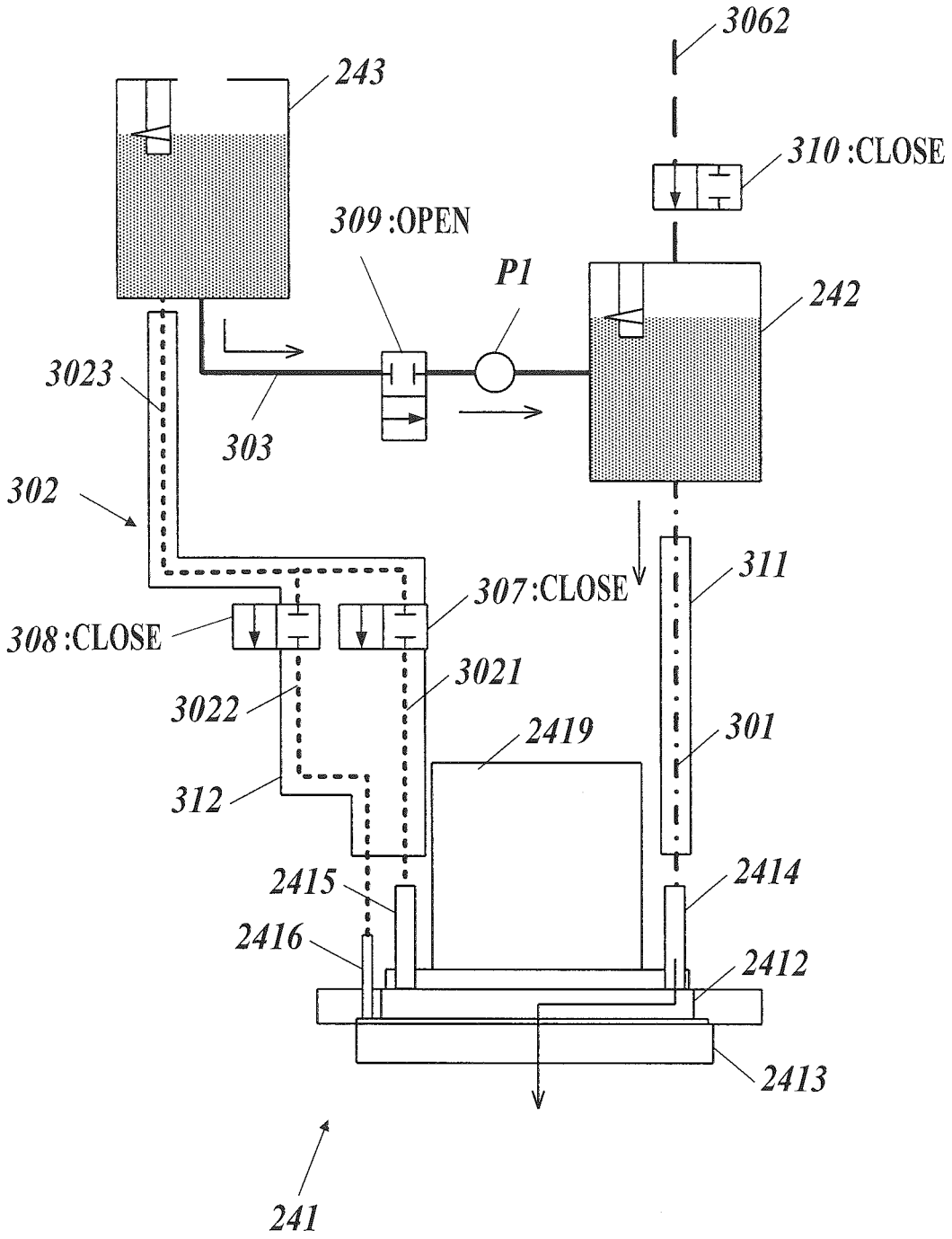
FIG. 9 shows opening and closing of each part and a flow of ink at the time of ejection maintenance.

First, the behavior of the image forming device 1 at the time of the ejection maintenance is described with reference to FIG. 9.

The control unit 40 performs control to operate a pump P1 to supply ink stored in the second reservoir part 243 to the first reservoir part 242 in the state in which the connection between the first reservoir part 242 and the pressure control unit 305 is closed with the solenoid valve 310 and the return path 302 is closed with the solenoid valves 307 and 308. This operation control supplies the ink stored in the second reservoir part 243 to the first reservoir part 242 to increase the pressure in the first reservoir part 242. At this time, the connection between first reservoir part 242 and the pressure control unit 305 is closed with the solenoid valve 310, and the pressure increased in the first reservoir part 242 acts in the direction of pushing the ink out from the first reservoir part 242 to the recording head 241. Further, at this time, the return path 302 is closed with the solenoid valves 307 and 308, and the ink pushed out to the recording head 241 is ejected from the nozzles 2411. The ejection of ink from the nozzles 2411 resolves clogging of the nozzles 2411, if any, and prevents defective image formation due to the clogging to enhance the image quality.

At the time of the ejection maintenance, the control unit 40 controls at least one of the solenoid valves 307 and 308 to open the return path 302 a predetermined time after the ink stored in the second reservoir part 243 is supplied to the first reservoir part 242. In this embodiment, the control unit 40 opens both of the solenoid valves 307 and 308 for the ink to flow through both of the first return path 3021 and the second return path 3022. Alternatively, the control unit 40 may open any one of them.

In the ejection maintenance, the ink stored in the second reservoir part 243 is supplied to the first reservoir part 242 to increase the pressure in the first reservoir part 242, and the increased pressure acts in the direction to eject ink from the nozzles 2411 of the recording head 241. Then, after a lapse of a predetermined time, the return path 302 is opened so that part of the pressure on the ink transmitted from the first reservoir part 242 to the recording head 241 is relieved toward the return path 302, thereby rapidly reducing the increased pressure on the ink in the first reservoir part 242 and the recording head 241. For example, at the time of the ejection maintenance, the return path 302 may be opened after a lapse of the time for ink ejection from the nozzles 2411 (e.g., about 1 to 3 seconds) to resolve the clogging of the nozzles 2411. This can quickly end the ink ejection from the nozzles 2411, preventing wasteful ink ejection.

Figure 10:
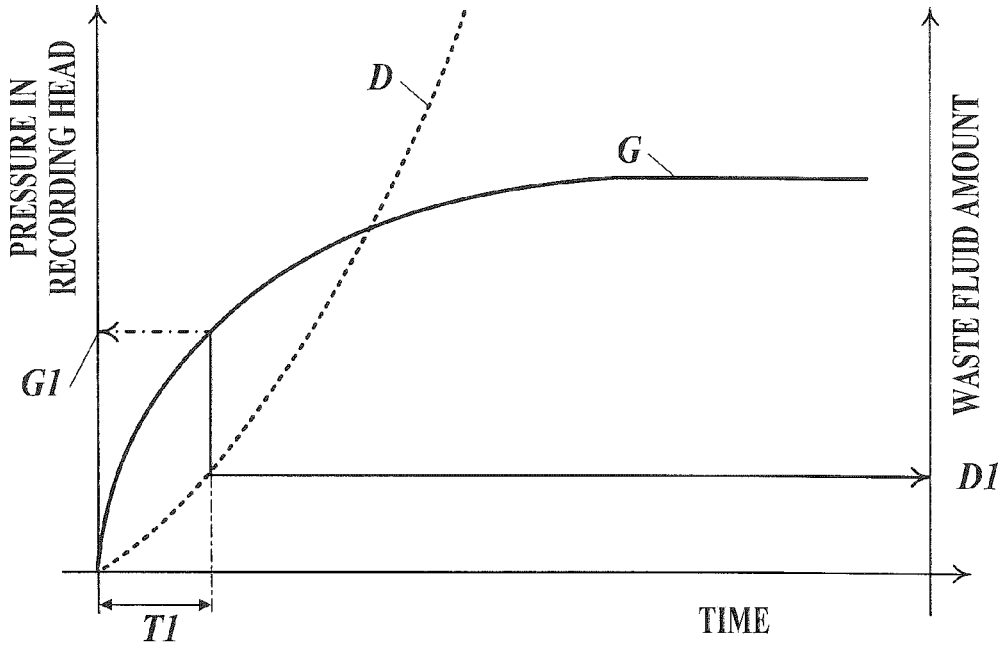
FIG. 10 shows an example correspondence relationship between the change in pressure applied to the ink to be supplied to a recording head (i.e., the pressure in the recording head), the time for which the pressure is applied, and the amount of ink ejected from nozzles (i.e., waste fluid amount)

FIG. 10 shows an example relationship between the change in pressure (i.e., pressure G in a recording head) applied to the ink to be supplied to a recording head 241, the time for which the pressure is applied, and the amount of ink (waste fluid amount D) to be ejected from the nozzles 2411.

At the time of the ejection maintenance, ink is supplied from a second reservoir part 243 to a first reservoir part 242 and ink is pushed out to the recording head 241, leading to an increase in pressure G in the recording head. With reference to FIG. 10, the waste fluid amount D is increased at an accelerated rate with the increase in pressure G in the recording head. For the image forming device 1 of this embodiment, the pressure G in the recording head and the operation time of the pump P1 for the first maintenance are adjusted on the basis of experimental results so as to prevent excessive waste fluid amount D and wasteful ink ejection. Specifically, adjustment is made so that, when the pump P1 is operated for the time T1 shown in FIG. 10, the pressure reaches G1 and the waste fluid amount is D1.

The relationship is not limited to the one shown in FIG. 10, which is merely an example, but may vary depending on the specific structure of each unit of the image forming device 1.

In this embodiment, the control unit 40 stops operating the pump P1 after a lapse of the predetermined time and before opening the return path 302, and closes the path 303 with the solenoid valve 309. This prevents the ink stored in the first reservoir part 242 from flowing backward to the second reservoir part 243.

Next, the behavior of the image forming device 1 at the time of the return current maintenance is described.

The return current maintenance includes two types of maintenances: upper flow path section maintenance mainly for removing air bubbles from ink in the upper flow path sections 2412, and lower flow path section maintenance mainly for removing air bubbles from ink in the lower flow path sections 2413.

Figure 11:
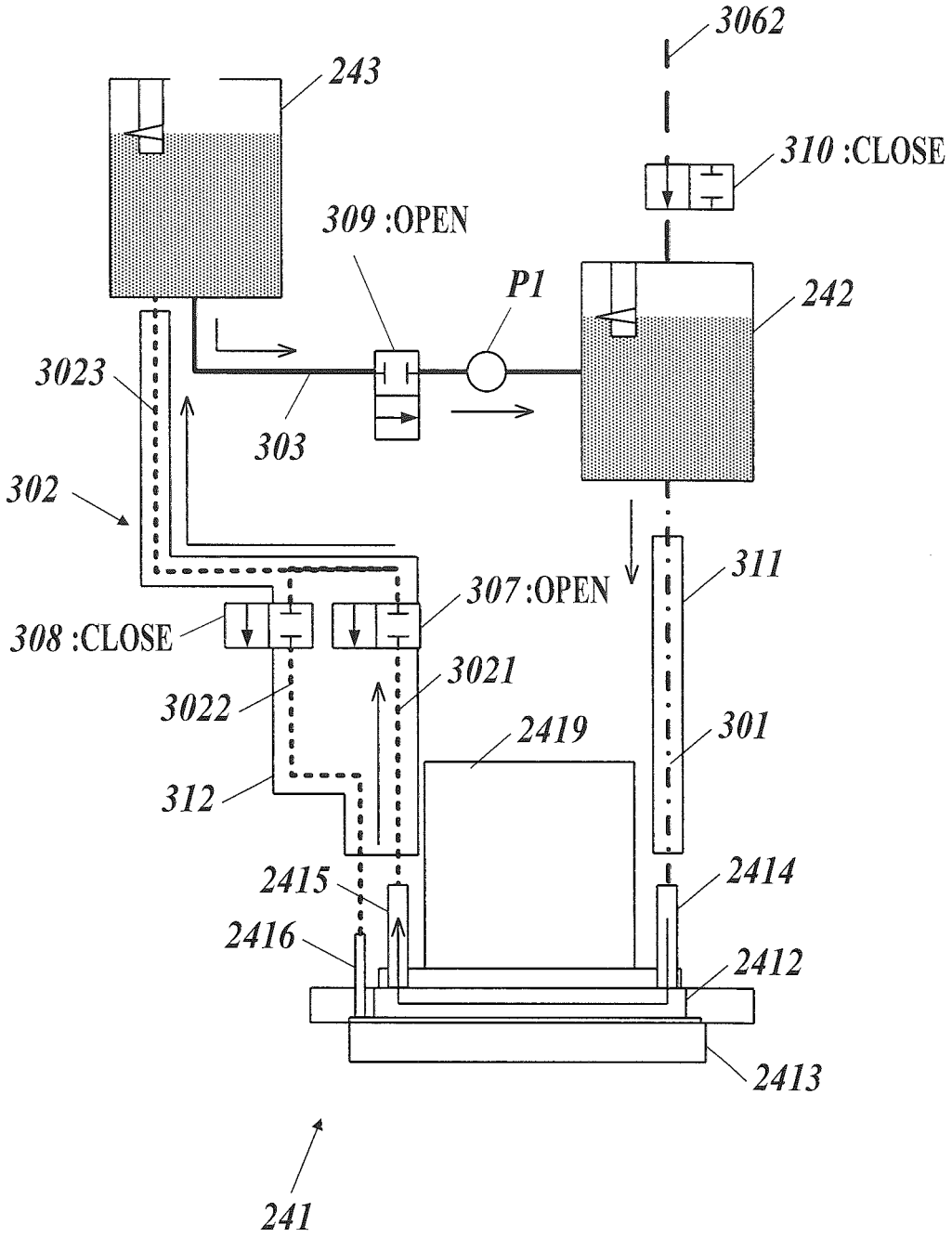
FIG. 11 shows opening and closing of each part and a flow of ink at the time of upper flow path section maintenance.

First, the behavior of the image forming device 1 at the time of the upper flow path section maintenance is described with reference to FIG. 11.

The control unit 40 performs control so as to operate a pump P1 to supply the ink stored in the second reservoir part 243 to the first reservoir part 242, in the state in which the connection between the first reservoir part 242 and the pressure control unit 305 is closed with the solenoid valve 310, the second return path 3022 is closed with the solenoid valve 308, and the first return path 3021 is opened with the solenoid valve 307. This operation control increases the pressure in the first reservoir part 242 in the same manner as the above, and the pressure pushes the ink in the first reservoir part 242 out to the recording head 241. At this time, the ink path via the second return path 3022 of the return path 302 is closed with the solenoid valve 308, while the ink path via the first return path 3021 of the return path 302 is opened with the solenoid valve 307. Accordingly, the ink pushed to the recording head 241 flows through the ink path via the first return path 3021 of the return path 302 to return to the second reservoir part 243. Since the first return path 3021 is connected to the outlet 2415 connecting to the ink flow path in the upper flow path section 2412, the ink supplied to the recording head 241 from the inlet 2414 flows through the upper flow path section 2412, the outlet 2415, and the first return path 3021 to return to the second reservoir part 243.

Figure 12:
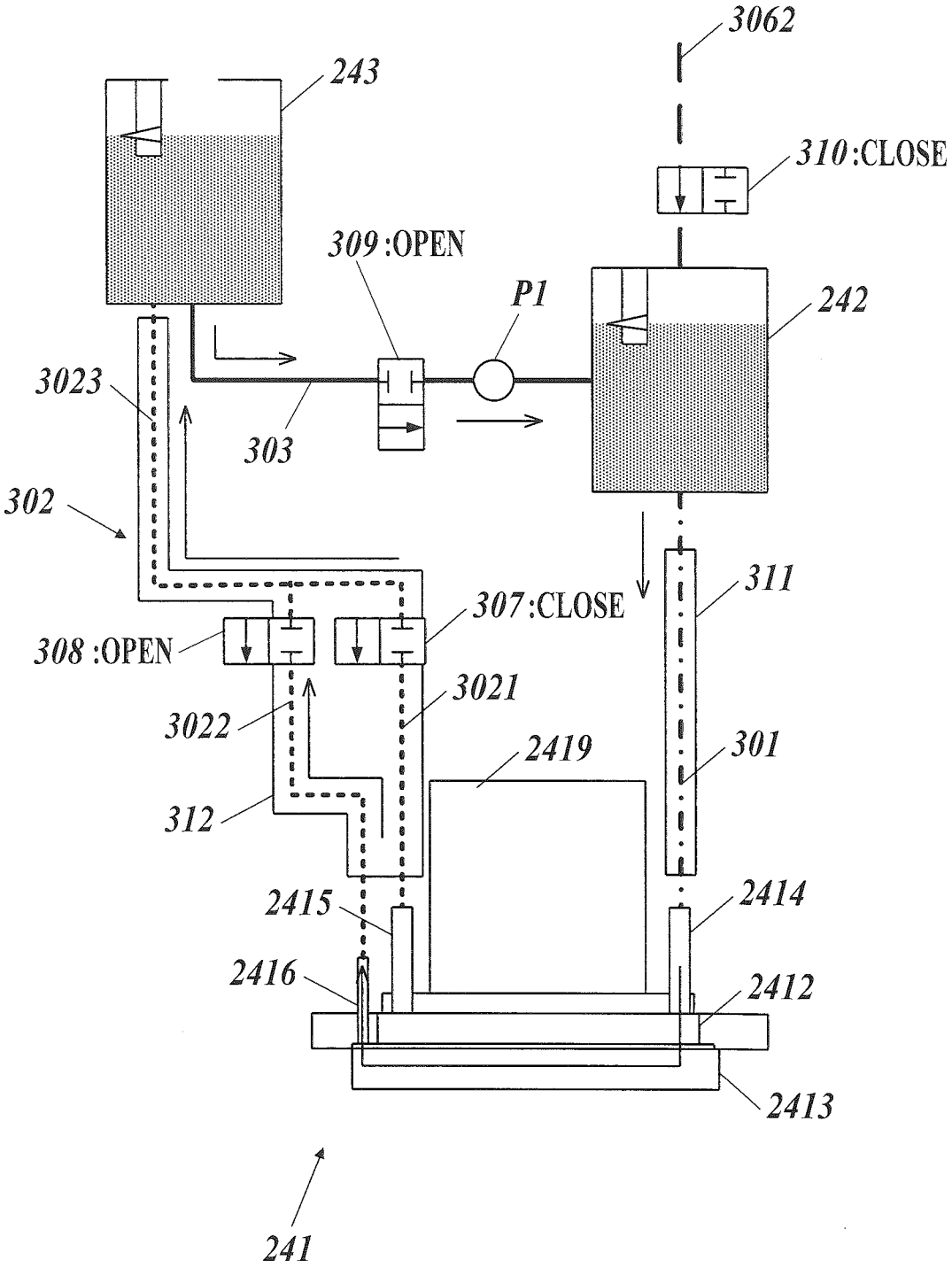
FIG. 12 shows opening and closing of each part and a flow of ink at the time of lower flow path section maintenance.

Next, the behavior of the image forming device 1 at the time of the lower flow path section maintenance is described with reference to FIG. 12.

The control unit 40 performs control so as to operate a pump P1 to supply the ink stored in the second reservoir part 243 to the first reservoir part 242, in the state in which the connection between the first reservoir part 242 and the pressure control unit 305 is closed with the solenoid valve 310, the first return path 3021 is closed with the solenoid valve 307, and the second return path 3022 is opened with the solenoid valve 308. This operation control increases the pressure in the first reservoir part 242 in the same manner as the above, and the pressure pushes the ink in the first reservoir part 242 out to the recording head 241. At this time, the ink path via the first return path 3021 of the return path 302 is closed with the solenoid valve 307, while the ink path via the second return path 3022 of the return path 302 is opened with the solenoid valve 308. Accordingly, the ink pushed to the recording head 241 flows through the ink path via the second return path 3022 of the return path 302 to return to the second reservoir part 243. Since the second return path 3022 is connected to the bypass 2416 connecting to the ink flow path in the lower flow path section 2413, the ink supplied to the recording head 241 from the inlet 2414 flows from the upper flow path section 2412 through the lower flow path section 2413, the bypass 2416, and the second return path 3022, to return to the second reservoir part 243.

The upper flow path section maintenance allows the ink in the upper flow path section 2412 to return to the second reservoir part 243, and the lower flow path section maintenance allows the ink in the lower flow path section 2413 to return to the second reservoir part 243. Such return of ink from the upper and lower flow path sections 2412 and 2413 removes air bubbles from the ink in the upper and lower flow path sections 2412 and 2413 when air bubbles are included in the ink. This prevents defective image formation and enhances image quality.

When the image forming device 1 supplies ink to a recording head in the return current maintenance, the ink supplied by a pump P1 to the first reservoir part 242 is stored in the first reservoir part 242. This means that the pressure directly applied to the ink by the operation of the pump P1 disperses when the ink is put in the first reservoir part 242, leading to significant smoothing. In other words, supplying ink to the recording head 241 through the first reservoir part 242 means that the pressure applied to the ink by the pump P1 is an indirect pressure. Accordingly, if a pulsation is generated on the ink by the pump P1, the pulsation dies down when the ink is put in the first reservoir part 242, resulting in even and smooth ink supply to the recording head 241. The return current maintenance can be performed through such ink supply.

At the time of the return current maintenance, part of the ink in the recording head 241 is ejected from the nozzles 2411 by the pressure applied to the ink supplied to the recording head 241.

At least one of the ejection maintenance and the return current maintenance may be started when a user's instructions are given through the operation display unit 80 or when a predetermined condition related to the behavior of the image forming device 1 is satisfied, for example. Examples of predetermined conditions to be satisfied include the case in which image formation has been performed on a predetermined number or more of recording media P, and the case in which a predetermined time has elapsed after the last image formation.

When performing at least one of the ejection maintenance and the return current maintenance, the control unit 40 allows the carriage control unit 245 to move the head units 24 to the position of the cleaning unit 27 to perform maintenance.

The processing related to the maintenance to be performed by the control unit 40 is described below with reference to the flowcharts.

Figure 13:
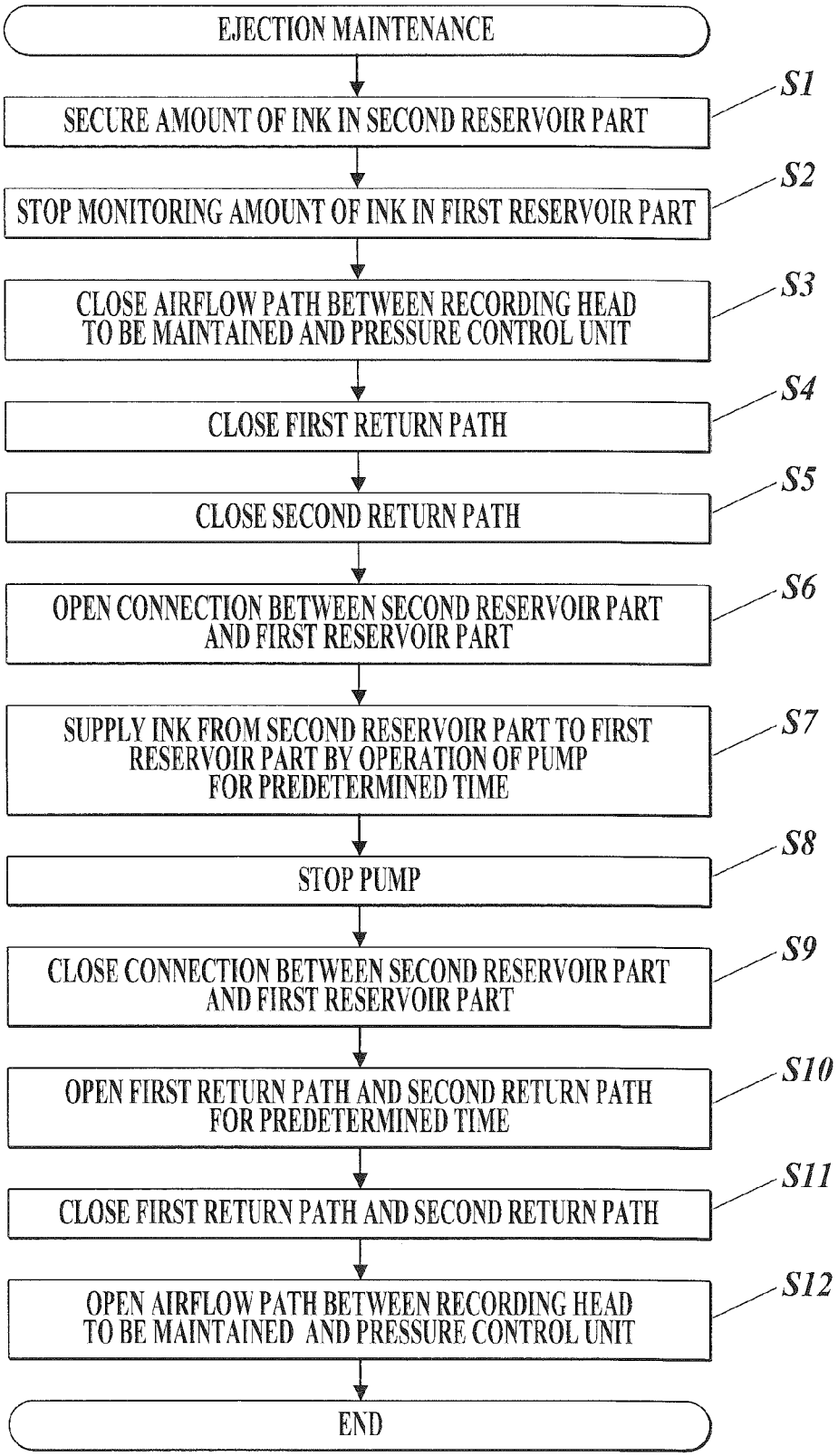
FIG. 13 is a flowchart showing an example processing flow related to ejection maintenance performed by a control unit.

First, example processing related to the ejection maintenance to be performed by the control unit 40 is described below with reference to the flowchart of FIG. 13.

The control unit 40 makes the amount of ink stored in a second reservoir part 243 sufficient for performing the ejection maintenance (Step S1). Specifically, for example, if the amount of remaining ink in the second reservoir part 243 is not below a predetermined remaining amount set for each of the reservoir parts, the control unit 40 determines that there is sufficient amount of ink for the maintenance. If the amount of remaining ink in the second reservoir part 243 is below the predetermined remaining amount set for each of the reservoir parts, the control unit 40 operates the pump disposed between the ink tank 244 and the second reservoir part 243 to supply ink to the second reservoir part 243.

The control unit 40 then stops monitoring the amount of remaining ink with the fluid level sensor 2421 in each of the first reservoir parts 242 (Step S2). The control unit 40 then controls the solenoid valves 310 so as to close the branching airflow paths 3062 which are connected to the first reservoir parts 242 to supply ink to target recording heads 241 for the ejection maintenance (Step S3).

The control unit 40 then controls the solenoid valves 307 so as to close the first return paths 3021 connected to the outlets 2415 of the target recording heads 241 for the ejection maintenance (Step S4). The control unit 40 further controls the solenoid valves 308 so as to close the second return paths 3022 connected to the bypasses 2416 of the target recording heads 241 for the ejection maintenance (Step S5).

The control unit 40 then controls the solenoid valves 309 on the paths 303, which are connected to the first reservoir parts 242 to supply ink to the target recording heads 241 for the ejection maintenance, so as to open the paths 303 (Step S6). The control unit 40 then operates the pumps P1 on the paths 303, which were opened at Step S6, for a predetermined time to supply ink from the second reservoir part to the first reservoir parts (Step S7).

The control unit 40 then stops operating the pumps P1 (Step S8), and controls the solenoid valves 309 on the paths 303, which were opened at Step S6, to close the paths 303 (Step S9).

The control unit 40 then controls the solenoid valves 307 and the solenoid valves 308 so as to open the first return paths 3021 and the second return paths 3022 of the return paths 302 connected to the target recording heads 241 for the ejection maintenance (Step S10). After a lapse of a predetermined opening time (e.g., 1 to 30 seconds), the control unit 40 controls the solenoid valves 307 and the solenoid valves 308 so as to close the first return paths 3021 and the second return paths 3022 of the return paths 302 which were opened at Step S10 (Step S11).

The control unit 40 then controls the solenoid valves 310 so as to open the branching airflow paths 3062 which were closed at Step S3 (Step S12), and ends the processing related to the ejection maintenance.

Figure 14:
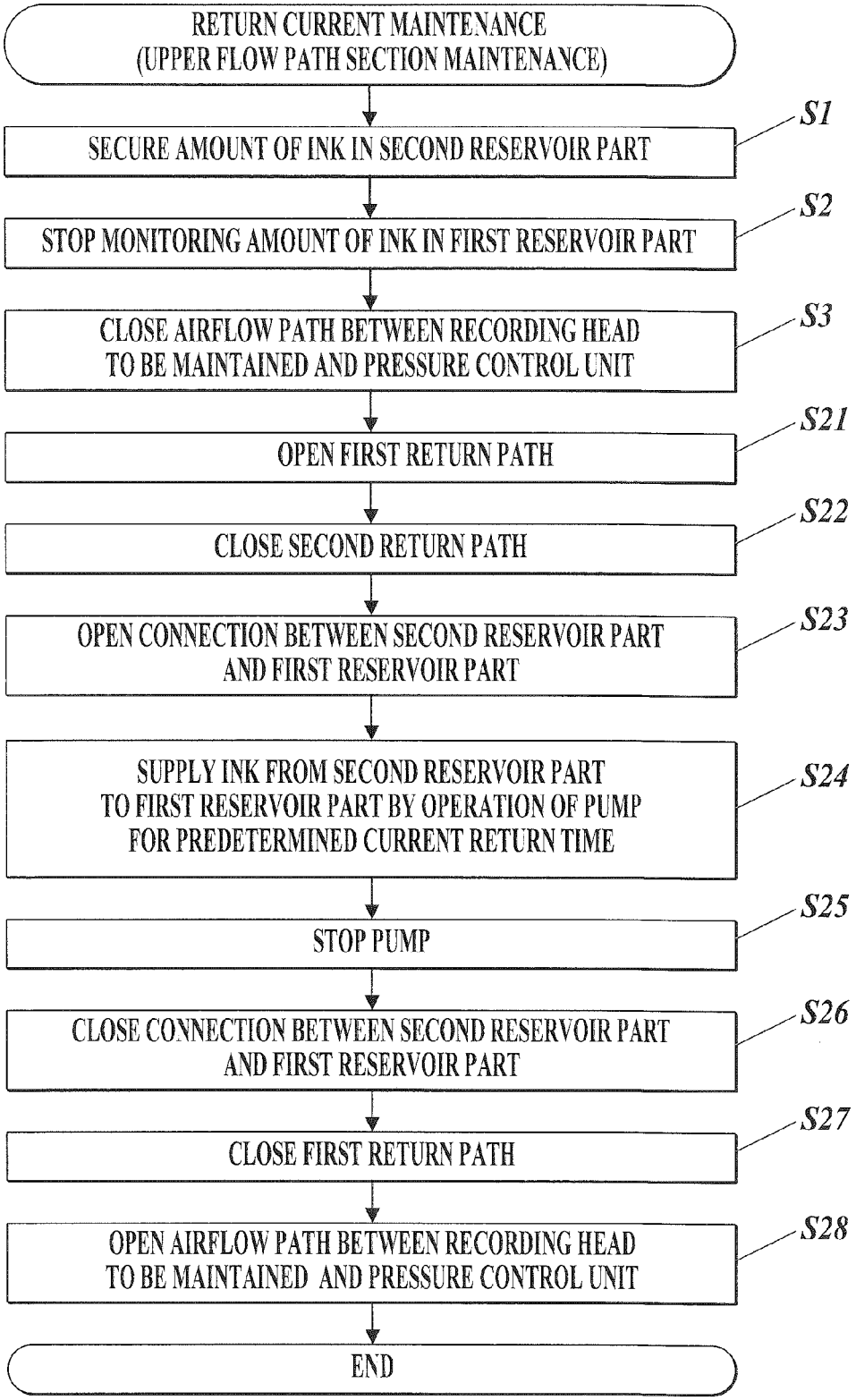
FIG. 14 is a flowchart showing an example processing flow related to upper flow path section maintenance performed by a control unit.

Next, example processing related to the upper flow path section maintenance, which is one form of the return current maintenance, to be performed by the control unit 40 is described with reference to the flowchart of FIG. 14.

As the control related to the upper flow path section maintenance, the control unit 40 performs the same processing as Steps S1-S3 in the processing related to the ejection maintenance.

The control unit 40 then controls the solenoid valves 307 so as to open the first return paths 3021 connected to the outlets 2415 of the target recording heads 241 for the upper flow path section maintenance (Step S21). The control unit 40 further controls the solenoid valves 308 so as to close the second return paths 3022 connected to the bypasses 2416 of the target recording heads 241 for the upper flow path section maintenance (Step S22).

The control unit 40 then controls the solenoid valves 309 on the paths 303, which are connected to the first reservoir parts 242 to supply ink to the target recording heads 241 for the upper flow path section maintenance, to open the paths 303 (Step S23). The control unit 40 then operates the pumps P1 on the paths 303, which were opened at Step S23, for a predetermined current return time (e.g., about 5 to 20 seconds) to supply ink from the second reservoir part to the first reservoir parts (Step S24).

The control unit 40 then stops operating the pumps P1 (Step S25), and controls the solenoid valves 309 on the paths 303, which were opened at Step S23, to close the paths 303 (Step S26).

The control unit 40 then controls the solenoid valves 307 so as to close the first return paths 3021 of the return paths 302 connected to the target recording heads 241 for the upper flow path section maintenance (Step S27).

The control unit 40 then controls the solenoid valves 310 so as to open the branching airflow paths 3062 which were closed at Step S3 (Step S28), and ends the processing related to the upper flow path section maintenance.

Figure 15:
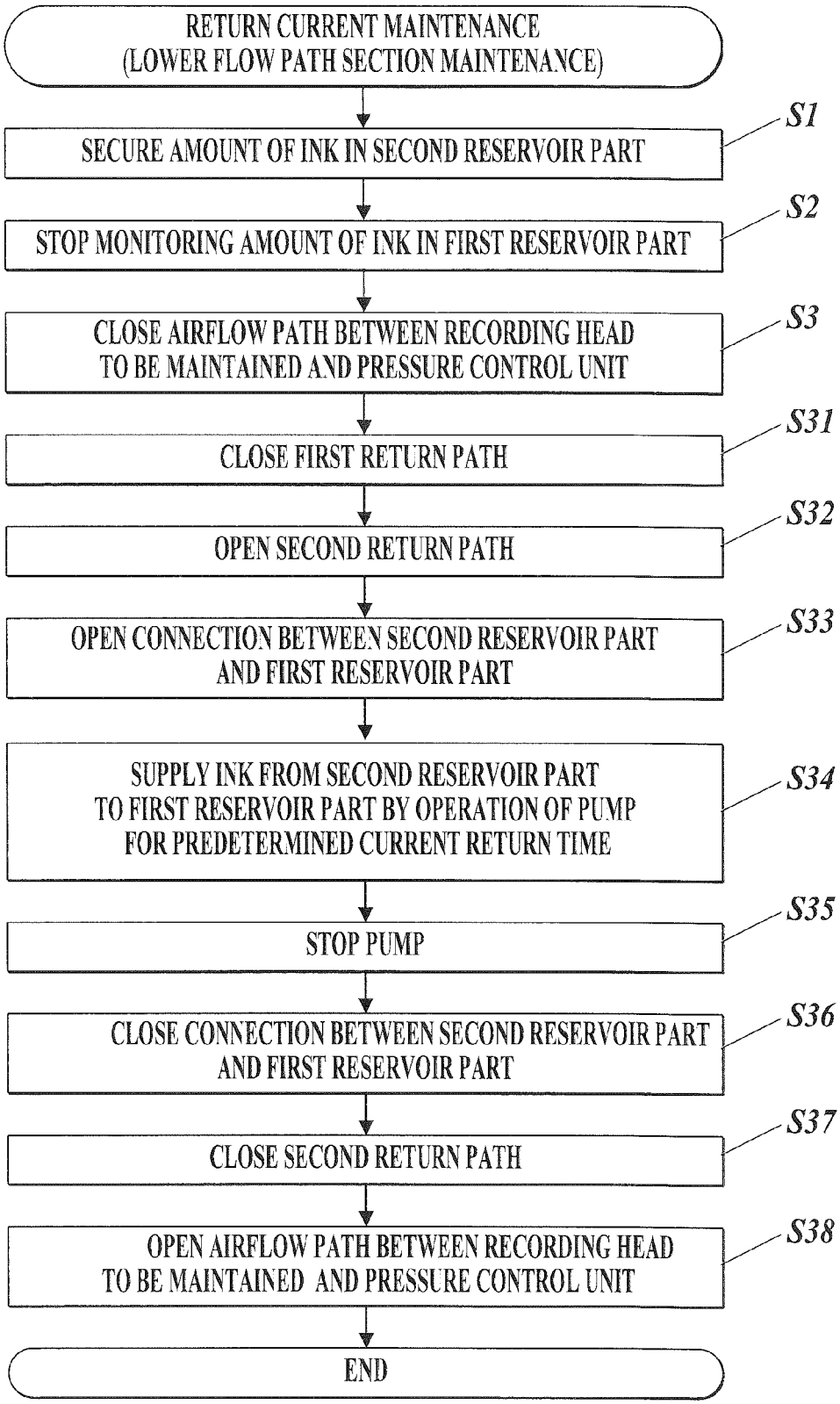
FIG. 15 is a flowchart showing an example processing flow related to lower flow path section maintenance performed by a control unit.

Next, example processing related to the lower flow path section maintenance, which is another form of the return current maintenance, to be performed by the control unit 40 is described with reference to the flowchart of FIG. 15.

As the control related to the lower flow path section maintenance, the control unit 40 performs the same processing as Steps S1-S3 in the processing related to the ejection maintenance.

The control unit 40 then controls the solenoid valves 307 so as to close the first return paths 3021 connected to the outlets 2415 of the target recording heads 241 for the lower flow path section maintenance (Step S31). The control unit 40 further controls the solenoid valves 308 so as to open the second return paths 3022 connected to the bypasses 2416 of the target recording heads 241 for the lower flow path section maintenance (Step S32).

The control unit 40 then controls the solenoid valves 309 on the paths 303, which are connected to the first reservoir parts 242 to supply ink to the target recording heads 241 for the lower flow path section maintenance, to open the paths 303 (Step S33). The control unit 40 then operates the pumps P1 on the paths 303, which were opened at Step S33, for a predetermined current return time (e.g., about 5 to 20 seconds) to supply ink from the second reservoir part to the first reservoir parts (Step S34).

The control unit 40 then stops operating the pumps P1 (Step S35), and controls the solenoid valves 309 on the paths 303, which were opened at Step S33, to close the paths 303 (Step S36).

The control unit 40 then controls the solenoid valves 308 so as to close the second return paths 3022 of the return paths 302 connected to the target recording heads 241 for the lower flow path section maintenance (Step S37).

The control unit 40 then controls the solenoid valves 310 so as to open the branching airflow paths 3062 which were closed at Step S3 (Step S38), and ends the processing related to the lower flow path section maintenance.

At the time of any of the maintenances, the suspension of monitoring of the amount of remaining ink in the first reservoir parts 242, which are carried out at Step S2, is lifted after the maintenance.

At the time of the return current maintenance, the control unit 40 may control the return path heaters 312 in such a way that the temperature of the ink passing through the return paths 302 is higher than that of the ink passing through the supply paths 301.

For example, the control unit 40 may control the return path heaters 312 in such a way that the temperature of the ink passing through the return paths 302 is about 5° C. higher than that of the ink passing through the supply paths 301.

This makes the viscosity of the ink lower at the time of passing through the return paths 302 than at the time of passing through the supply paths 301. Accordingly, a larger amount of ink flows through the return paths 302, where relatively high temperature reduces the ink viscosity and facilitates the ink flow, than near the nozzles 2411, where relatively low temperature increases the ink viscosity and makes the ink flow difficult. This allows effective return of ink current to the second reservoir part 243, and reduces the amount of ink ejected from the nozzles 2411 at the time of the return current maintenance.

The control unit 40 may control the supply path heaters 311 and the return path heaters 312 in such a way that the temperature of the ink passing through the supply paths 301 and the temperature of the ink passing through the return paths 302 are higher at the time of the return current maintenance than at the time of image formation.

For example, the control unit 40 may control the supply path heaters 311 and the return path heaters 312 in such a way that the ink, which has been supplied from the first reservoir parts 242 at a predetermined temperature for image formation (e.g., about 75 to 80° C.), is heated to a predetermined temperature (e.g., about 95 to 100° C.) when the ink passes through the supply paths 301 and the return paths 302 at the time of the return current maintenance.

This reduces the viscosity of the ink passing through the recording heads 241, enabling effective removal of air bubbles from the ink in the recording heads 241 at the time of the return current maintenance.

At the time of the return current maintenance, the control unit 40 may control the supply path heaters 311 and the return path heaters 312 in such a way that the temperature of the ink passing through the supply paths 301 and the temperature of the ink passing through the return paths 302 are higher than the ink temperatures for image formation, and in such a way that the temperature of the ink passing through the return paths 302 is higher than the temperature of the ink passing through the supply paths 301. In this case, for example, the control unit 40 controls the supply path heaters 311 and the return path heaters 312 in such a way that the ink is heated to about 95° C. when passing through the supply paths 301 and to about 100° C. when passing through the return paths 302.

According to the image forming device 1 of this embodiment, the control unit 40 performs ejection maintenance in which ink is ejected from the nozzles 2411 of recording heads 241 by operating the pumps P1 to supply the ink stored in the second reservoir part 243 to the first reservoir parts 242 in the state in which the connections between the first reservoir parts 242 and the pressure control unit 305 are closed with the solenoid valves 310 and the return paths 302 are closed with the solenoid valves 307 and the solenoid valves 308. Accordingly, the pressure directly applied to the ink by the operation of the pumps P1 disperses when the ink is put in the first reservoir parts 242, and then, uniform and even ejection maintenance can be performed for the nozzles of the recording heads 241. This achieves reliable nozzle maintenance. Further, since the image forming device 1 does not use dampers etc., which have low pressure resistance, ink can be ejected with a high pressure for nozzle maintenance.

Further, the control unit 40 performs return current maintenance through return of ink in recording heads 241 to the second reservoir part 243 by operating the pumps P1 to supply the ink stored in the second reservoir part 243 to the first reservoir parts 242 in the state in which the connections between the first reservoir parts 242 and the pressure control unit 305 are closed with the solenoid valves 310, and the return paths 302 are opened with the solenoid valves 307 and the solenoid valves 308. Accordingly, the pressure directly applied to the ink by the operation of the pumps P1 disperses when the ink is put in the first reservoir parts 242, allowing the pressure applied to the ink by the pumps P1 to be indirect pressure. In other words, the ink pulsation calms down when the ink is put in the first reservoir parts 242 and the ink does not have pulsation when the ink is supplied to the recording heads 241, regardless of the type and motion of the pumps P1. The image forming device 1 thus can supply ink to the recording heads 241 smoothly and evenly. The return current maintenance through such an ink supply achieves the maintenance of the nozzles without meniscus instability on the nozzle plane due to the ink pulsation. Further, the image forming device 1, which does not use dampers having a low pressure resistance, can perform the maintenance with a high pressure.

Further, the control unit 40 controls the return path heaters 312 in such a way that the temperature of the ink passing through the return paths 302 is higher than the temperature of the ink passing through the supply paths 301. Accordingly, the ink has a lower viscosity in passing through the return paths 302 than in passing through the supply paths 301, and thus a larger amount of ink can pass through the return paths 302. This enables ink to return to the second reservoir part 243 more effectively and can reduce the amount of ink to be ejected from the nozzles 2411 at the time of the return current maintenance.

Further, the control unit 40 controls the supply path heaters 311 and the return path heaters 312 in such a way that the temperature of the ink passing through the supply paths 301 and the temperature of the ink passing through the return paths 302 are higher than the temperatures of the ink at the time of image formation. Accordingly, the ink has a lower viscosity when passing through the recording heads 241 at the time of the return current maintenance, enabling more effective removal of air bubbles included in the ink in the recording heads 241.

Further, the control unit 40 controls the solenoid valves 307 and the solenoid valves 308 in such a way that the return paths 302 open a predetermined time after the ink stored in the second reservoir part 243 is supplied to the first reservoir parts 242 at the time of the ejection maintenance. Accordingly, part of the pressure on the ink which has been delivered from the first reservoir parts 242 to the recording heads 241 can be released to the return paths 302, and thus the increased pressure on the ink in the first reservoir parts 242 and the recording heads 241 can be reduced more quickly. Ink ejection from the nozzles 2411 can thus be quickly completed, preventing ejecting ink wastefully.

Further, the phase of the ink changes depending on the temperature of the ink. Liquid ink ejected at a predetermined temperature for image formation (e.g., about 75 to 80° C.) from the nozzles 2411 of the recording heads 241 onto a recording medium P reduces in temperature on the recording medium P and quickly becomes a gel or solid state to cure. Image formation on the recording medium P is thus achieved without bleeding. In other words, since the ink ejected onto a recording medium P can be quickly stabilized on the recording medium P, unintended state change, such as blending of ink drops ejected onto the recording medium P, is prevented. Accordingly, high-definition image formation is achieved. This produces great effects especially for recording media having low absorbability of ink (e.g., coated paper).

Further, since the number of the nozzles 2411 corresponds to the maximum width of a recording medium P in the X direction, a single-pass method can be adopted, in which method images can be formed without moving the image forming drum 21 and the recording heads 241 relatively to each other in the X direction at the time of image formation. An image forming device 1 which can achieve rapid image formation and has high productivity can thus be provided.

It should be understood that the embodiments of the present invention disclosed here are not limitative but are illustrative in all respects. The scope of the present invention is defined not by the descriptions given above but defined by the claims and is intended to include all the variations within the meaning and scope of the equivalents of the claims.

For example, a plurality of recording heads 241 may be connected to one first reservoir part 242.

Figure 16:
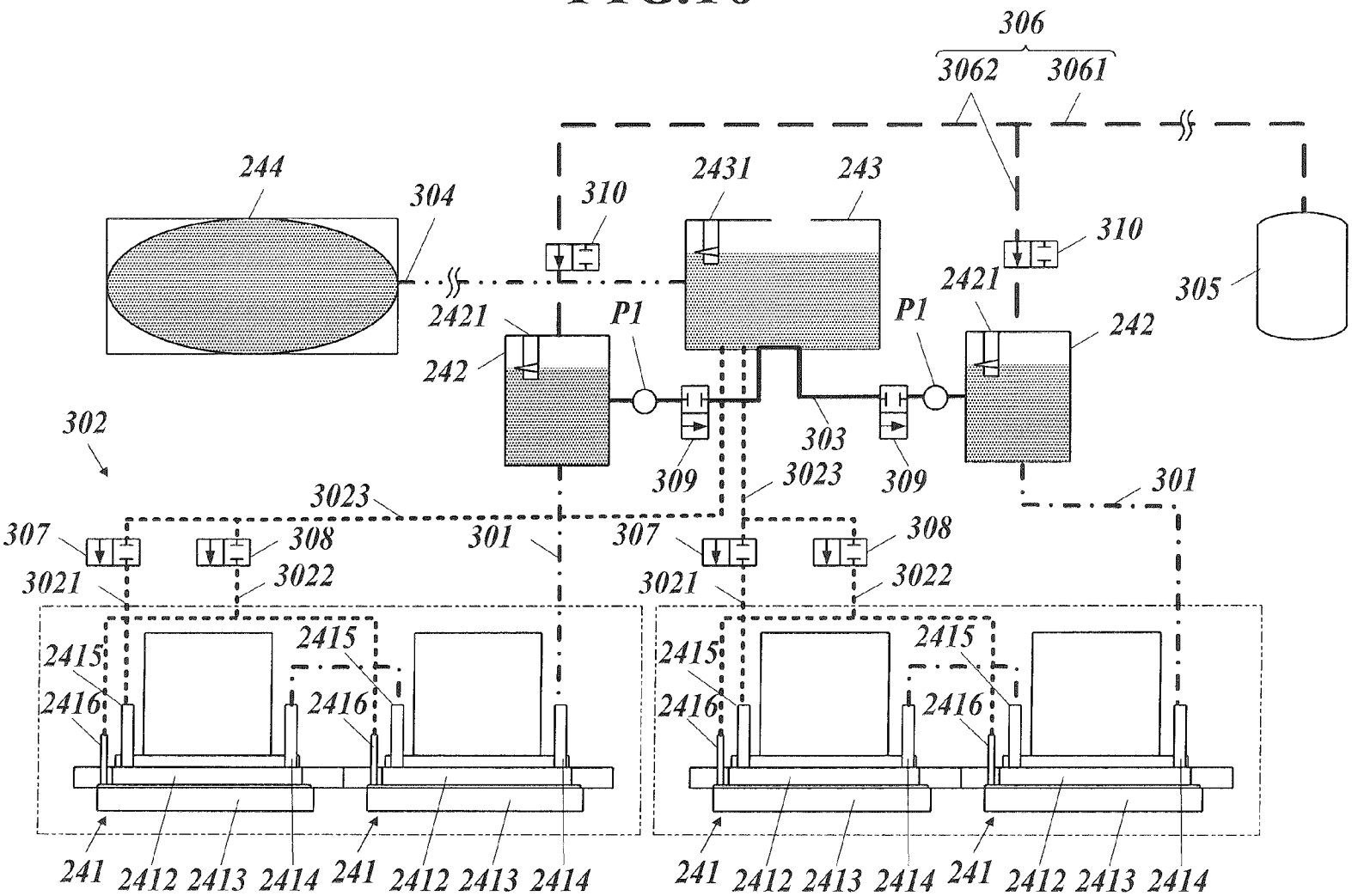
FIG. 16 shows an example in which a plurality of recording heads are connected to one first reservoir part.

FIG. 16 shows an example in which a plurality of recording heads 241 are connected to one first reservoir part 242.

In the example shown in FIG. 16, two recording heads 241 are connected to one first reservoir part 242. Specifically, the connection configuration is such that the outlet 2415 of one of the two recording heads 241 connected to one first reservoir part 242 is connected to the inlet 2414 of the other of the two recording heads 241, and thereby an ink supply path and an ink return path are integrated. Bypasses 2416 have a connection configuration such that the return paths connected to the respective bypasses 2416 are integrated with each other into one return path. Such an example connection configuration can connect a plurality of recording heads 241 to one first reservoir part 242.

The example shown in FIG. 16 is illustrative only, and the configuration is not limited to this example. For example, three or more recording heads 241 may be connected to one first reservoir part 242.

Further, each return path 302 does not necessarily have to branch and join.

Figure 17:
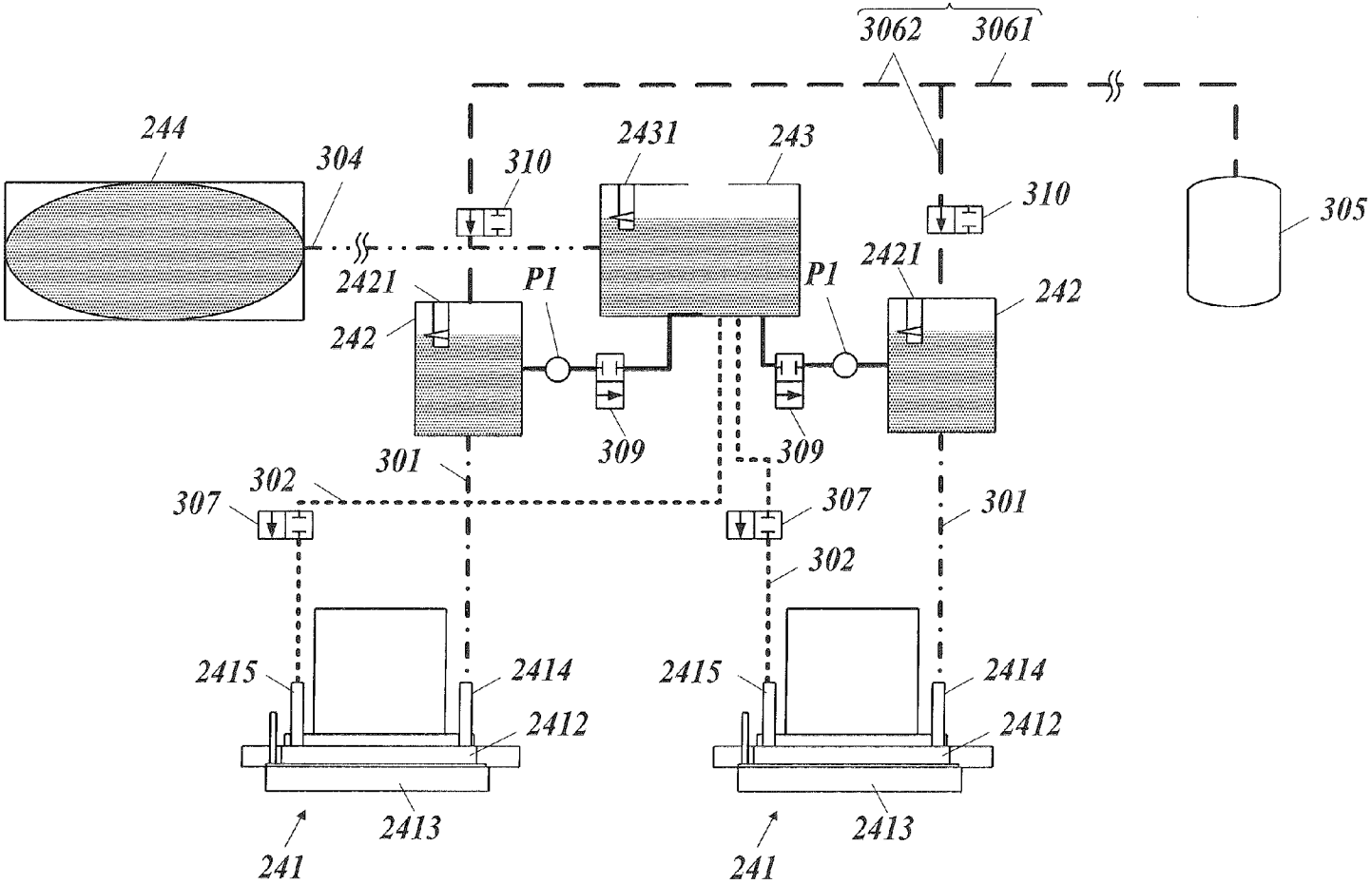
FIG. 17 shows an example in which each return path is a single path.

FIG. 17 shows an example in which each return path 302 is a single path.

In the example shown in FIG. 17, the connections between the bypasses 2416 and the second reservoir part 243 are omitted, and each outlet 2415 and the second reservoir part 243 are connected with each other with a return path 302, which is a single path. In this case, the bypasses 2416 are preferably stopped up to prevent the ink from leaking out.

Among the upper flow path sections 2412 and the lower flow path sections 2413, the upper flow path sections 2412 are connected to the second reservoir part 243 with the return paths 302 in the example shown in FIG. 17. Alternatively, the lower flow path sections 2413 may be connected to the second reservoir part 243. Alternatively, both of the upper flow path sections 2412 and lower flow path sections 2413 may be connected to the second reservoir part 243 with independent return paths.

Further, although the above-described image forming device 1 has head units 24 each including a plurality of recording heads 241, a single recording head 241 may be provided instead. An image forming device according to the present invention may be a single-pass inkjet image forming device 1 as described above, and the image forming device may include a single recording head 241 having a plurality of nozzles, the number of which corresponds to the maximum width of a recording medium P, in the direction perpendicular to the direction in which the recording head 241 and the recording medium P move relatively to each other at the time of image formation.

Further, an ink that does not change in phase may be employed. In this case, too, the ink has higher fluidity at a higher temperature than at a lower temperature, and thus the effects of an ink fluidity increase due to heating of the ink in the supply paths and the return paths are achieved adequately. The ink that changes in phase, however, has greater effects of heating ink in the supply paths and the return paths because such an ink more remarkably increases in fluidity when heated.

Further, although the image forming device 1 of the above-described embodiment performs both of the ejection maintenance and the return current maintenance, the image forming device 1 may perform only one of the maintenances.

INDUSTRIAL APPLICABILITY

The present invention is applicable to the field of image formation through ejection of ink onto a recording medium.

The invention claimed is:

1. An image forming device comprising:

a recording head including a plurality of nozzles to eject ink onto a recording medium to form an image;

a first reservoir part in which the ink to be supplied to the recording head is stored;

a supply path connecting the recording head to the first reservoir part, the ink supplied from the first reservoir part passing through the supply path to the recording head;

a pressure control unit connected to the first reservoir part, the pressure control unit allowing a pressure in the nozzles of the recording head to be a negative pressure state through the first reservoir part and the supply path;

a first switching part to make a switch between opening and closing of a connection between the first reservoir part and the pressure control unit;

a second reservoir part in which the ink to be supplied to the first reservoir part is stored;

a supply part to supply the ink stored in the second reservoir part to the first reservoir part;

a return path connecting the recording head to the second reservoir part, part of the ink which has been supplied to the recording head passing through the return path to return to the second reservoir part;

a second switching part to make a switch between opening and closing of the return path;

a first heater to heat the ink at the return path;

a second heater to heat the ink at the supply path; and a control unit to control an operation of each of the first switching part, the second switching part, and the supply part, wherein in a state in which the connection between the first reservoir part and the pressure control unit is closed with the first switching part and the return path is closed with the second switching part, the control unit performs control to operate the supply part so that the ink stored in the second reservoir part is supplied to the first reservoir part to allow the nozzles of the recording head to eject the ink;

in a state in which the connection between the first reservoir part and the pressure control unit is closed with the first switching part and the return path is opened with the second switching part, the control unit performs control to operate the supply part so that the ink stored in the second reservoir part is supplied to the first reservoir part to return the ink in the recording head to the second reservoir part;

at a time of the control to return the ink in the recording head to the second reservoir part, the control unit controls the first heater in such a way that a temperature of the ink in the return path is higher than a temperature of the ink in the supply path; and the control unit controls the first heater and the second heater in such a way that the temperature of the ink in the supply path and the temperature of the ink in the return path are higher at the time of the control to return the ink in the recording head to the second reservoir part than at a time of image formation.

2. The image forming device according to claim 1, wherein at a time of the control of ejecting the ink from the nozzles of the recording head, the control unit controls the second switching part to open the return path a predetermined time after the ink stored in the second reservoir part is supplied to the first reservoir part.

3. The image forming device according to claim 1, wherein a phase of the ink changes depending on a temperature thereof.

4. The image forming device according to claim 1, wherein the number of the nozzles corresponds to a maximum width of the recording medium in a direction perpendicular to a direction in which the recording head and the recording medium move relatively to each other at a time of image formation.

* * * * *